US012753684B2

(12) United States Patent
Shaw

(10) Patent No.: US 12,753,684 B2
(45) Date of Patent: Oct. 6, 2026

(54) MODIFIED GAS ASSISTED PLUNGER LIFT

(71) Applicant: Silverwell Technology Limited, Cambridge (GB)

(72) Inventor: Joel David Shaw, Houston, TX (US)

(73) Assignee: Silverwell Technology Limited, Cambridge (GB)

( * ) Notice: Subject to any disclaimer, the term of this patent is extended or adjusted under 35 U.S.C. 154(b) by 0 days.

(21) Appl. No.: 19/222,618

(22) Filed: May 29, 2025

(65) Prior Publication Data

US 2025/0369320 A1 Dec. 4, 2025

Related U.S. Application Data

(60) Provisional application No. 63/653,547, filed on May 30, 2024.

(51) Int. Cl.

| | |
|---|---|
| ***E21B 43/12*** | (2006.01) |
| ***E21B 23/03*** | (2006.01) |
| ***E21B 47/00*** | (2012.01) |

(52) U.S. Cl.

CPC ..... *E21B 43/123* (2013.01); *E21B 23/03* (2013.01); *E21B 47/00* (2013.01)

(58) Field of Classification Search

CPC ..... E21B 43/123; E21B 43/122; E21B 23/03; E21B 34/06; E21B 34/10; E21B 47/00

See application file for complete search history.

(56) References Cited

U.S. PATENT DOCUMENTS

| | | | |
|---|---|---|---|
| 6,070,608 | A | 6/2000 | Pringle |
| 6,148,843 | A | 11/2000 | Pringle |
| 8,281,865 | B2 | 10/2012 | Joseph et al. |
| 8,651,173 | B2 | 2/2014 | Joseph et al. |
| 8,925,638 | B2 | 1/2015 | Wygnanski |
| 2020/0355050 | A1 | 11/2020 | Josefsen |

FOREIGN PATENT DOCUMENTS

| | | | | |
|---|---|---|---|---|
| AU | 2015213301 A1 | * | 9/2015 | ..... E21B 43/123 |
| CA | 2583922 A1 | * | 11/2007 | ..... E21B 23/03 |
| EP | 1279795 A1 | | 1/2003 | |
| WO | 2022155478 A1 | | 7/2022 | |
| WO | 2024043786 A1 | | 2/2024 | |

OTHER PUBLICATIONS

International Search Report & Written Opinion issued in International Application No. PCT/GB2025/051178; report mail date Aug. 11, 2025; pp. 1-15.

* cited by examiner

*Primary Examiner* — Zakiya W Bates

(74) *Attorney, Agent, or Firm* — Bracewell LLP; Keith R. Derrington

(57) ABSTRACT

A piloted valve in a production string is actuated for injecting gas into a production string for gas assisted plunger lift ("GAPL") operations in a well. Actuation of the piloted valve occurs by operation of a surface controlled gas lift valve having an outlet in communication with the piloted valve. The piloted valve is installed in a side pocket mandrel of the production string, and after formation pressure around a well has dropped to a level requiring assisted lift.

20 Claims, 19 Drawing Sheets

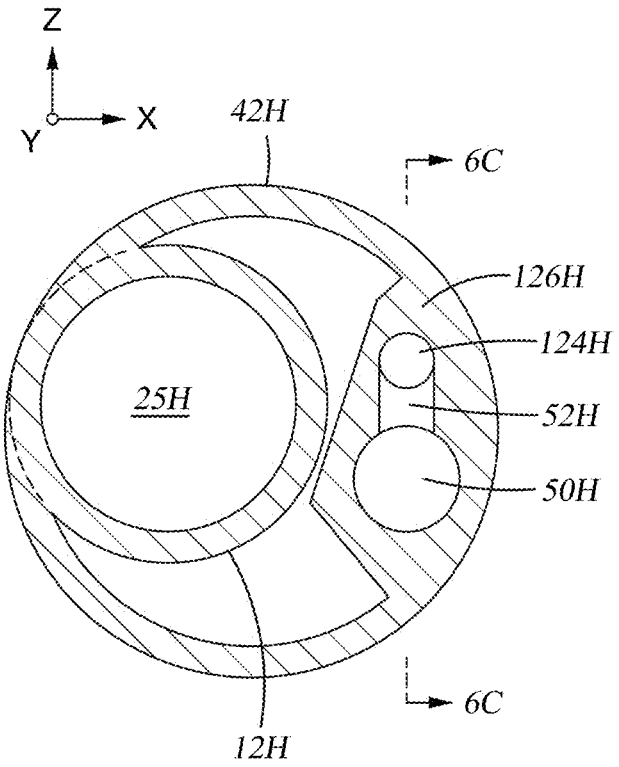
Fig. 6B
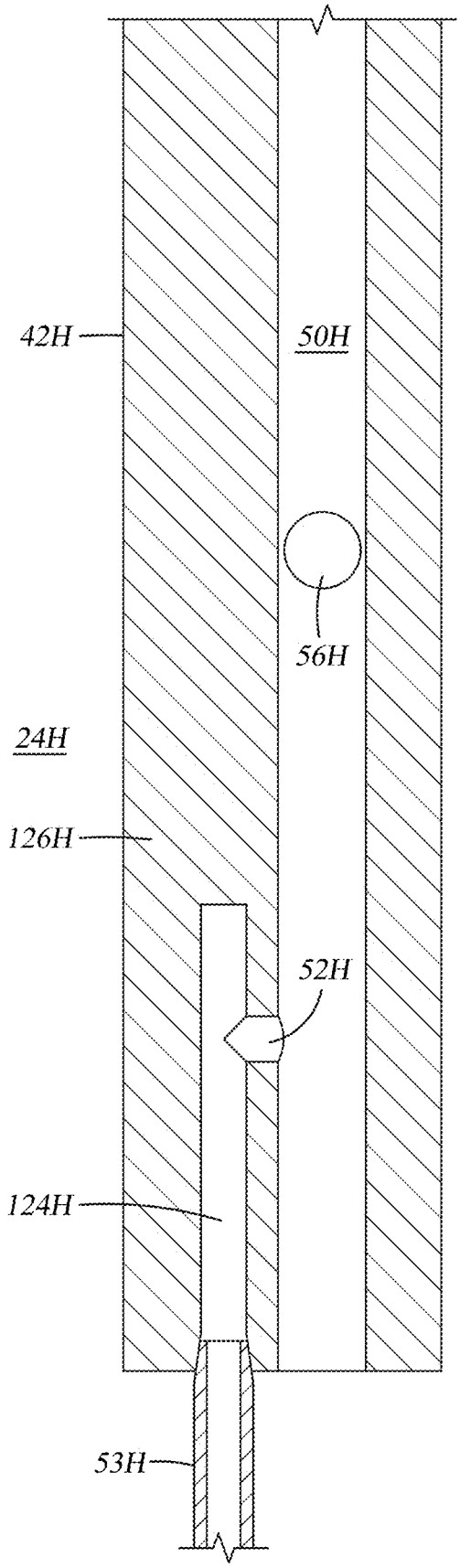
Fig. 6C
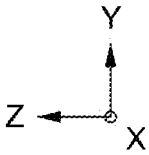

MODIFIED GAS ASSISTED PLUNGER LIFT

CROSS-REFERENCE TO RELATED APPLICATIONS

This application claims priority to and the benefit of U.S. Provisional Application Ser. No. 63/653,547, filed May 30, 2024, the full disclosure of which is incorporated by reference herein in its entirety and for all purposes.

BACKGROUND OF THE INVENTION

1. Field of Invention

The present disclosure relates to retrofitting a wellbore completion to perform gas assisted plunger lift.

2. Description of Prior Art

A gas lift system is a type of artificial lift sometimes used for assisting with the production of liquid from inside a wellbore. When the liquid being lifted is in production tubing installed in the wellbore, the lift gas is usually directed into an annulus between the production tubing and sidewalls of the well, and then routed into the production tubing through a gas lift valve. Conversely, when the liquid is in the annulus, the lift gas is injected into the tubing, and through the gas lift valve into the annulus. Gas lift is commonly employed when pressure in a formation surrounding the well is insufficient to urge fluids to surface that are inside of the production tubing. By injecting sufficient lift gas into the production tubing, static head pressure of fluid inside the production tubing is reduced to below the pressure in the formation, so that the formation pressure is sufficient to push the fluids inside the production tubing to surface. Fluids that are usually in the production tubing are hydrocarbon liquids and gases produced from the surrounding formation.

Plunger lift systems typically employ a plunger that is supported at a particular depth inside the production tubing. Liquid hydrocarbons being produced from the well flow into the production tubing and upward around or through the plunger. A column of the liquid hydrocarbons accumulates above the plunger inside the production tubing. Periodically gas from surface is injected into the production tubing and below the plunger, which forces the plunger and the column of liquid hydrocarbons to a wellhead assembly on surface. From inside the wellhead assembly the liquid hydrocarbons flow into a production line, which directs the liquid hydrocarbons away from the wellsite for collection and/or processing. Shortcomings of the plunger lift systems is that their operations do not consider conditions affecting production rates of the associated wells.

SUMMARY OF THE INVENTION

Disclosed is a method of wellbore operations that includes injecting lift gas into the wellbore through a piloted valve in a side pocket mandrel of production tubing installed in the wellbore and controlling operation of the piloted valve from surface. Controlling operation of the piloted valve optionally includes actuating a surface controlled gas lift valve that is in selective fluid communication with the piloted valve. In embodiments the method further includes conducting gas lift operations in the wellbore by actuating a surface controlled gas lift valve for a period of time prior to injecting the lift gas through the piloted valve, and installing the piloted valve in the side pocket mandrel. In alternatives the lift gas injected through the piloted valve mixes with fluid inside the production tubing to form a mixture that flows upward inside the production tubing to surface, and optionally the lift gas injected through the piloted valve is used for conducting gas assisted plunger lift operations in the wellbore. In one embodiment, a blind insert is installed in the side pocket mandrel while the gas lift operations are conducted in the wellbore by actuating the surface controlled gas lift valve.

Another method of wellbore operations is disclosed that includes for a period of time, injecting lift gas into the wellbore through a surface controlled gas lift valve that has an outlet port in communication with a side pocket mandrel in a string of production tubing in the wellbore, after the period of time, installing a piloted valve in the side pocket mandrel and in fluid communication with the surface controlled gas lift valve, and injecting lift gas into the wellbore through the piloted valve by activating the surface controlled gas lift valve. In alternatives, the lift gas injected through the piloted valve mixes with fluid inside the production tubing to form a mixture that flows upward inside the production tubing to surface, and optionally the lift gas injected through the piloted valve is used for conducting gas assisted plunger lift operations in the wellbore. The method further optionally includes removing an insert from the side pocket mandrel prior to installing the piloted valve. In an example, flow characteristics of the piloted valve are different from flow characteristics of the surface controlled gas lift valve. In an embodiment, the flow characteristics of the piloted valve are based on monitoring conditions in the wellbore. A cycle time of the piloted valve optionally differs from a cycle time of the surface controlled gas lift valve based on monitoring conditions in the wellbore. The method includes an alternative in which an open time of the piloted valve differs from an open time of the surface controlled gas lift valve based on monitoring conditions in the wellbore.

A system for use in wellbore operations is disclosed that includes a pilot operated valve ("POV"), where the POV includes a valve actuator, a POV inlet port in communication with an annulus circumscribing a production string in the wellbore, and a POV outlet port in communication with a bore in the production string. The system further includes a surface controlled gas lift valve ("SCGLV") having a SCGLV inlet in communication with the annulus and a SCGLV outlet in communication with the actuator, the SCGLV having an open configuration in which the SCGLV inlet and outlet are in fluid communication and a closed configuration in which a flow barrier is between the SCGLV inlet and outlet, the SCGLV changeable into the open configuration when activated. The POV is optionally installed in a side pocket mandrel of the production string, and in an alternative, the SCGLV is coupled to the production string and a nipple connects the SCGLV outlet to the POV actuator. In one example the POV includes an elongated body, a chamber inside the body and a valve member selectively moveable in and out of a flow path between the POV inlet and outlet ports, and optionally the valve member is moveable out of the flow path when the SCGLV is activated.

BRIEF DESCRIPTION OF DRAWINGS

Some of the features and benefits of the present invention having been stated, others will become apparent as the description proceeds when taken in conjunction with the accompanying drawings, in which:

FIG. 6B is an axial sectional view of the side pocket mandrel of FIG. 6A and taken along lines 6B-6B.

FIG. 6C is an elevational sectional view of a portion of the side pocket mandrel of FIG. 6B and taken along lines 6C-6C.

Figure 1A:
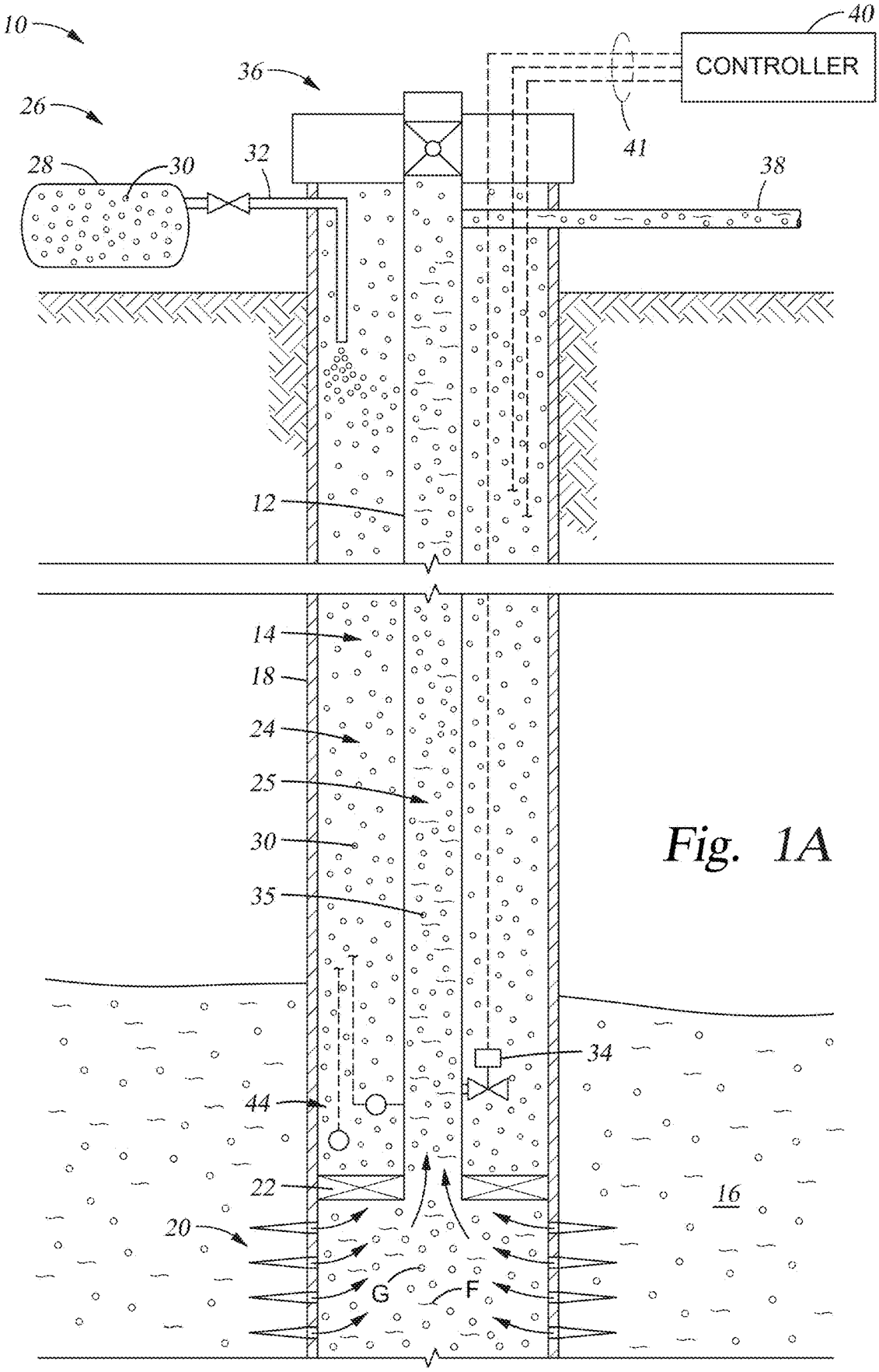
FIG. 1A is a side partial sectional view of an example of a well having a surface controlled gas lift valve.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of a well system 10, which includes a string of production tubing 12 installed within a wellbore 14 that intersects a subterranean formation 16. The wellbore 14 is lined with casing 18 that has a number of perforations 20 shown projecting radially outward from the wellbore 14 into the surrounding formation 16. In this example, the perforations 20 provide a pathway for fluid F to flow into the wellbore 14 from the formation 16. In the example shown the fluid F is made up primarily of liquid with some small bubbles of gas G mixed within. A packer 22 circumscribes a downhole end of tubing 12 to block the fluid F from flowing into an annulus 24 between the tubing 12 and casing 18, and instead directs the fluid F to a bore 25 in the production tubing 12.

The well system 10 includes a lift gas system 26 for assisting the flow of the fluid F uphole within the bore 25 of production tubing 12. An example of a lift gas source 28 is shown on the surface, embodiments of which include an adjacent well, a pipeline, or a vessel. Lift gas source 28 provides lift gas 30, which is shown being injected into the annulus 24 through an injection line 32. Lift gas 30 inside injection line 32 is at a designated pressure so that the lift gas 30 is forced downhole within annulus 24 to a surface controlled gas lift valve ("SCGLV") 34 shown mounted on an outer surface of the production tubing 12. SCGLV 34 is intermittently opened to allow the lift gas 30 into the bore 25 of production tubing 12, once in the bore 25, bubbles 35 of lift gas 30 are formed inside the fluid F. The lower density bubbles 35 reduce the density of the fluid F to assist the flow of fluid F uphole inside bore 25 and to a wellhead assembly 36 shown mounted over the wellbore 14 and connected to an end of production tubing 12. Inside wellhead assembly 36, the fluid F is directed to a production line 38 shown attached to a lateral side of wellhead assembly 36. Inside production line 38, fluid F is carried to a location that is offsite for transportation or to a processing facility (not shown). In the example of FIG. 1A, a controller 40 is schematically illustrated outside of wellbore 14 and in signal communication with the SCGLV 34 via communication means 41. Examples of communication means 41 include electrically conducting wire, fiber optics, hydraulics, and wireless, such as telemetry. Further optionally included are sensors 44 that are in temperature and pressure communication with annulus 24 and/or bore 25, and which transmit downhole conditions to controller 40 via communication means 41. In alternatives, the SCGLV 34 is actuated in response to signals delivered to SCGLV 34 from controller 40 or manually from operations personnel. Examples of actuation include the SCGLV 34 being fully open to allow lift gas 30 injection into the bore 25, fully closed to block lift gas 30 injection into the bore 25, or partially opened to allow a less than full flow of lift gas 30 into the bore 25.

Figure 2:
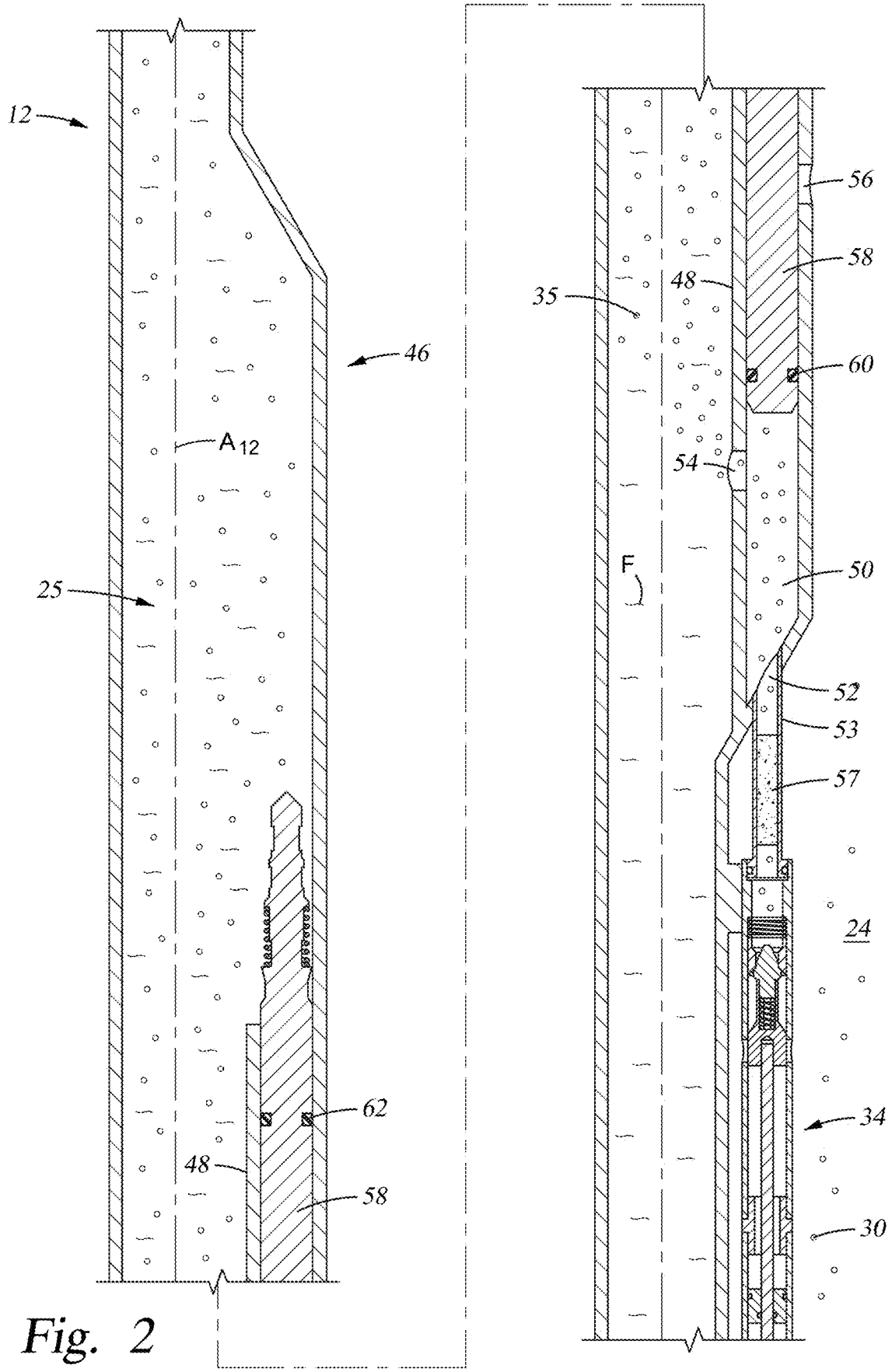
FIG. 2 is a side sectional view of an example of the surface controlled gas lift valve of FIG. 1A in a side pocket mandrel and injecting lift gas into production tubing.

Shown in a side sectional view in FIG. 2 is an example of the production tubing 12 with the SCGLV 34 connected to a side pocket mandrel 46 of the production tubing 12; which is an enlarged diameter portion of tubing 12. Axial ends of the side pocket mandrel 46 extend obliquely from an outer surface of tubing 12 and are angled towards one another. In the example shown, SCGLV 34 connects to a downhole end of the side pocket mandrel 46. Inside the side pocket mandrel 46 is a skirt 48 shown extending along a path that is generally parallel with an axis $A_{12}$ of production tubing 12, a downhole end of skirt 48 attaches to the downhole end of side pocket mandrel 46, and an uphole end of skirt 48 is proximate a mid-portion of side pocket mandrel 46. Lateral edges of skirt 48 attach to inner sidewalls of side pocket mandrel 46 at angularly spaced apart locations. A cylinder 50 is defined between skirt 48 and inner sidewalls of the side pocket mandrel 46. An inlet port 52 is formed through the downhole end of side pocket mandrel 46, a nipple 53 connects port 52 to an outlet of SCGLV 34, which provides communication between SCGLV 34 and cylinder 50. A side port 54 is formed radially through the skirt 48, and which provides a pathway of lift gas 30 within the cylinder 50 to flow into the bore 25.

In the side pocket mandrel 46 of FIG. 2, a contingency port 56 is formed radially through an outer side wall of side pocket mandrel 46, which as described in more detail below, provides an inlet for a contingency flow of lift gas 30 when and if the SCGLV 34 is a non-operational state. An example of the SCGLV 34 being in a non-operational state is that the SCGLV 34 remains in a fully open/closed or partially open/closed configuration, and is not responsive to command signals, such as from surface via communication means 41 (FIG. 1A). Another example of a non-operational state of SCGLV 34 is a blockage 57 in port 52 or nipple 53 that forms a barrier to fluid flow therethrough. In a non-limiting example of operation during which SCGLV 34 is in an operational state, communication from annulus 24 to inside of cylinder 50 through the port 56 is blocked by an insert 58 shown installed within the cylinder 50. An example of SCGLV 34 being in an operational state, is that the SCGLV 34 is selectively opened and closed in response to command signals from surface transmitted via communication means 41 (FIG. 1A) to inject lift gas 30 into bore 25. In the example of FIG. 2, insert 58 is elongated and substantially solid. O-ring seals 60, 62 are shown circumscribing the insert 58 at spaced apart locations, and which respectively form barriers to fluid flow from contingency port 56 to side port 54 and an opening of cylinder 50.

Figure 3:
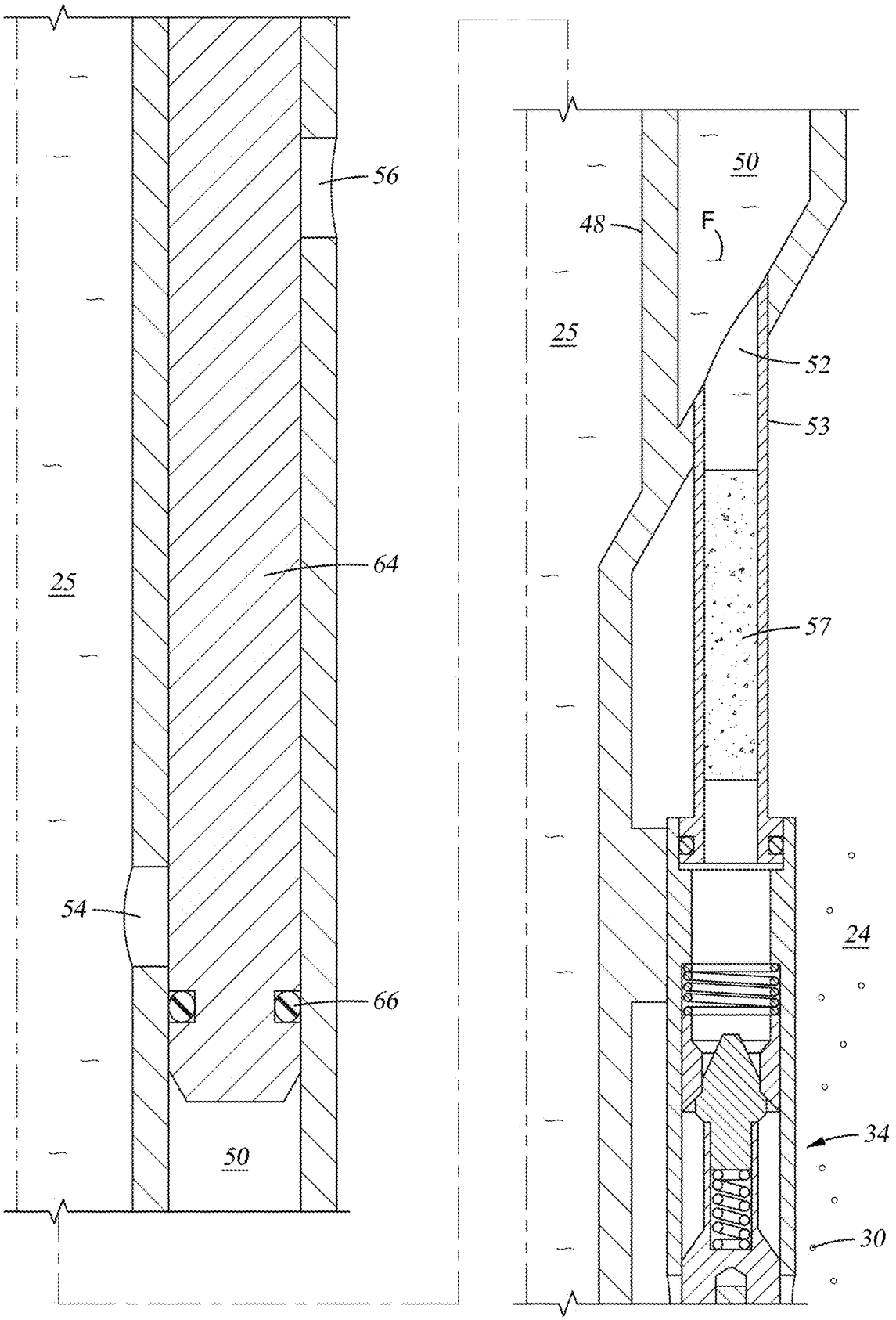
FIG. 3 is a side sectional view of an example of the surface controlled gas lift valve of FIG. 2 out of service.

Shown in a side sectional view in FIG. 3 is an example in which the SCGLV 34 of FIG. 2 is in a non-operational state, and a blind insert 64 is disposed in cylinder 50 in an example attempt to block lift gas 30 in the annulus 24 from reaching the bore 25 through the SCGLV 34 or ports 54, 56 in the side pocket mandrel 46. In this example, the blind insert 64 is inserted into the cylinder 50 after the insert 58 (FIG. 2) has been removed from within cylinder 50. A problem encountered is that the presence of fluid F, which is not fully compressible, remains within cylinder 50 and so that blind insert 64 is prevented from being inserted within cylinder 50 to a location such that an O-ring seal 66 circumscribing insert 64 remains adjacent side port 54, and cannot isolate inlet 54 from SCGLV 34.

Figure 4A:
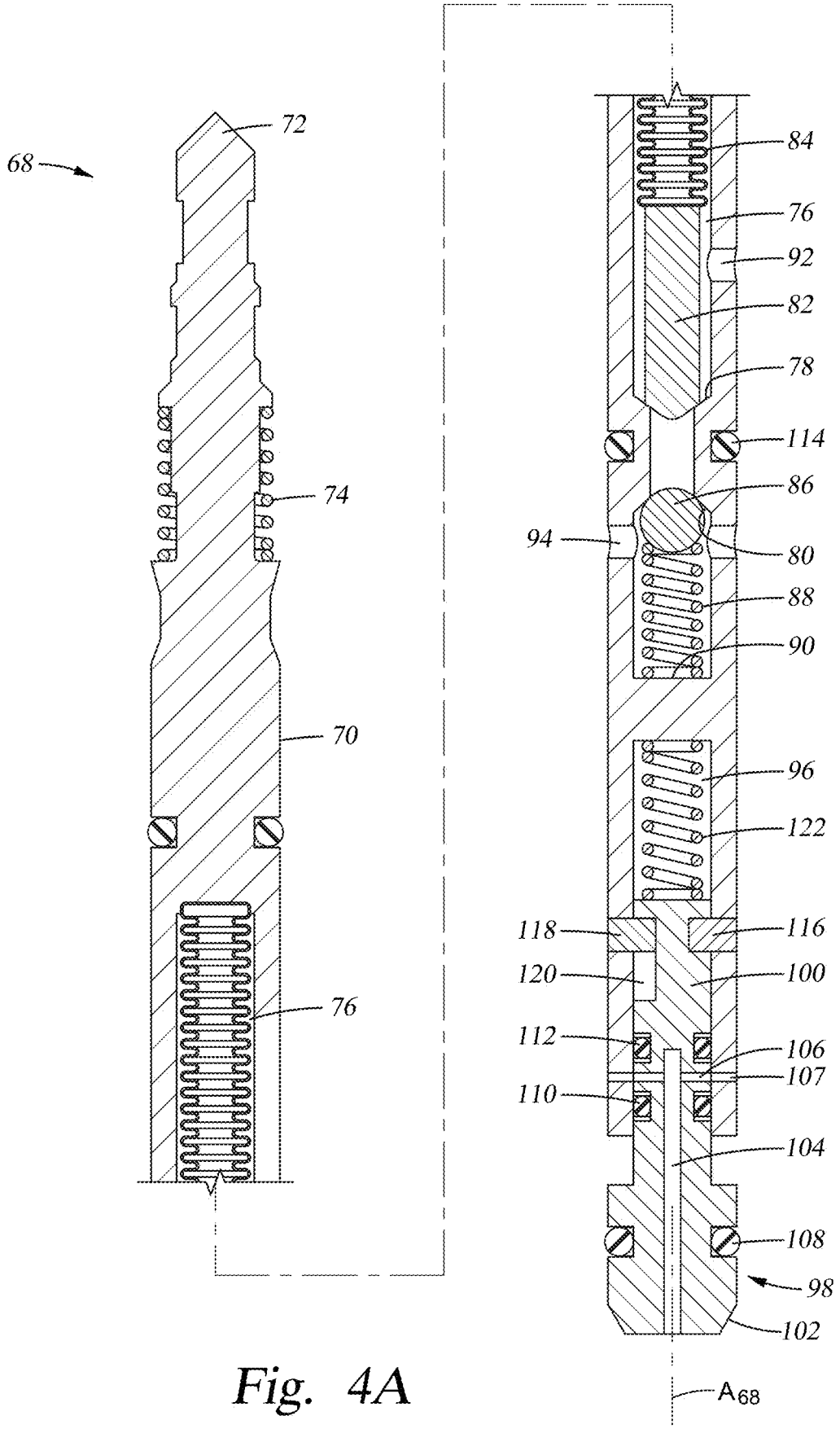
FIG. 4A is a side sectional view of an example of a contingency insert for use when the surface controlled gas lift valve of FIG. 2 is out of service.

Shown in a side sectional view in FIG. 4A is an example of a contingency insert 68 equipped to compensate for the incompressible fluid problem illustrated in FIG. 3. Contingency insert 68 includes a body 70 having an uphole end 72 profiled similar to what is commonly known as a fishing neck. Adjacent the uphole end 72 is a recess along an outer surface of body 70 and in which a spring 74 is installed, spring 74 is part of a latching mechanism for retrieving the insert 68. A chamber 76 is formed within a mid-portion of body 70, chamber 76 has an outer diameter that transitions radially inward to form an uphole-facing shoulder 78, the outer diameter transitions radially outward a distance away from shoulder 78 to form a downhole-facing shoulder 80. A valve member 82 is shown in chamber 76 having a downhole end that is rounded and in contact with shoulder 78, an uphole end of valve member 82 is generally planar and shown attached to a downhole end of bellows 84. An uphole end of bellows 84 is mounted to an uphole end of chamber 76. Another valve member 86 is inside chamber 76 shown abutting shoulder 80. Valve member 86 is shown as a generally spherical member and biased against shoulder 80 by a spring 88, an end of spring 88 opposite valve member 86 abuts an end wall 90, which defines a downhole end of chamber 76. In the example shown, chamber 76 is isolated from the surrounding environment by the bellows 84. An inlet port 92 is formed radially into the body 70, which extends into chamber 76 and adjacent a lateral surface of valve member 82. An exit port 94 extends radially into body 70 and intersects chamber 76 at a location adjacent valve member 86. The combination of the valve members 82, 86, ports 92, 94, chamber 76, and bellows 84 is configured to operate substantially the same as an injection pressure operated ("IPO") valve. An example of an IPO valve is found in Shaw, U.S. Pat. No. 11,441,401, which is assigned to the assignee of the present application and incorporated by reference herein in its entirety and for all purposes. A receptacle 96 is shown formed into an end of body 70 opposite from uphole end 72, in the example shown receptacle 96 is a generally cylindrical void having an uphole end that is spaced away location downhole of end wall 90. A bleed plug 98 is shown having a shaft 100 that inserts into the receptacle 96. Bleed plug 98 includes a nose portion 102 shown with an outer diameter exceeding shaft 100, nose portion 102 attaches to an end of shaft 100 outside of receptacle 96. A passage 104 extends axially through the bleed plug 98 and along a path substantially parallel with axis $A_{68}$ of insert 68. Inside shaft 100 are ducts 106 that project radially outward from passage 104, in the example of FIG. 4A ducts 106 are registered with bleed ports 107 that extend radially from the receptacle 96 to an outer surface of body 70. An O-ring 108 circumscribes an outer surface of the nose portion 102, and O-rings 110, 112 circumscribe shaft 100 on opposing sides of the ducts 106. O-rings 114 are also shown circumscribing body 70 at an axial location between shoulders 78, 80.

Figure 4B:
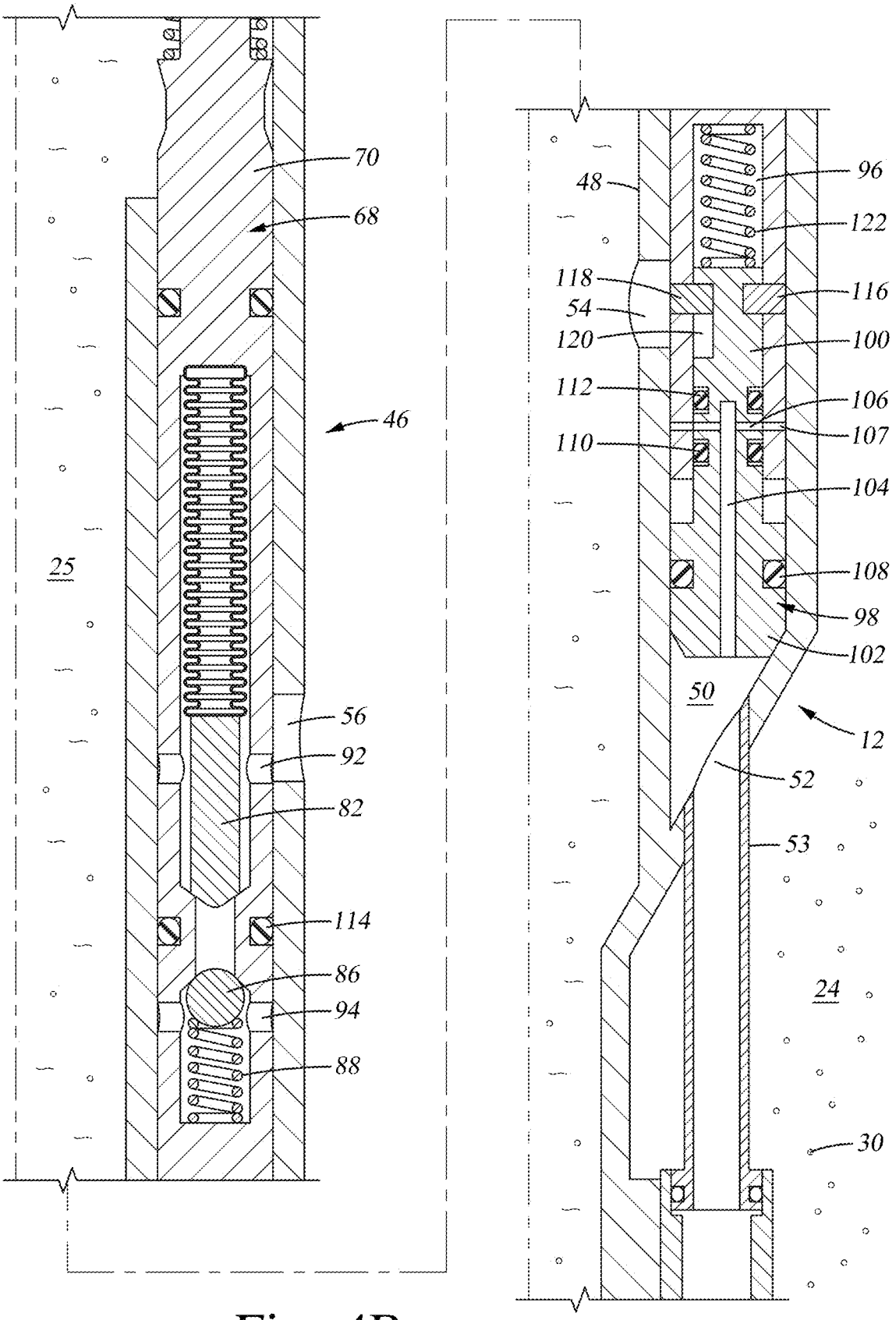
FIGS. 4B-4D are side sectional views of an example of installing the contingency insert of FIG. 4A into the side pocket mandrel of FIG. 2.
Figure 4C:
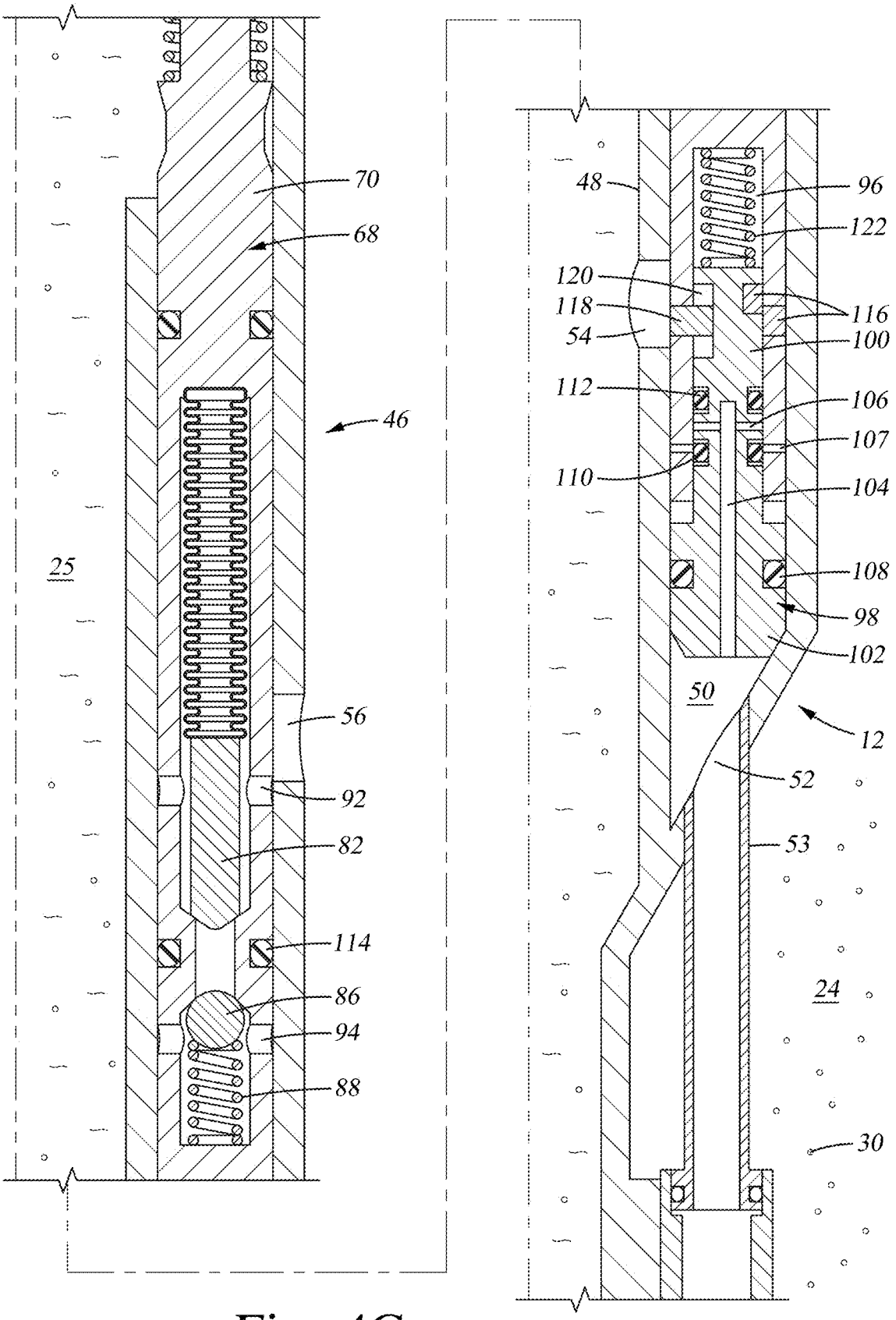

Shown in FIGS. 4B and 4C is insertion of the contingency insert 68 into the cylinder 50 and how the fluid within cylinder 50 is vented through the bleed plug 98, which allows for insertion of the contingency insert 68 to a designated location within the cylinder 50. More specifically, in FIG. 4B the nose plug 98 is shown having been inserted to a bottom portion of cylinder 50, and the fluid pooled in the bottom portion of cylinder 50 being ported into the passage 104 and exiting into the bleed port 107 via the ducts 106, and where it escapes from the cylinder 50 through the side port 54. Referring back to FIG. 4A, shown is a shear pin 116 that extends radially through shaft 100 and body 70, and which retains shaft 100 in a fixed location and so that ducts 106 and port 107 remain in registration with one another. A retaining pin 118 projects radially through the side wall of body 70 and into a recess 120 that extends axially along an outer surface of shaft 100. The retaining pin 118 limits axial reciprocating motion of shaft 100 within the receptacle 96.

Figure 4D:
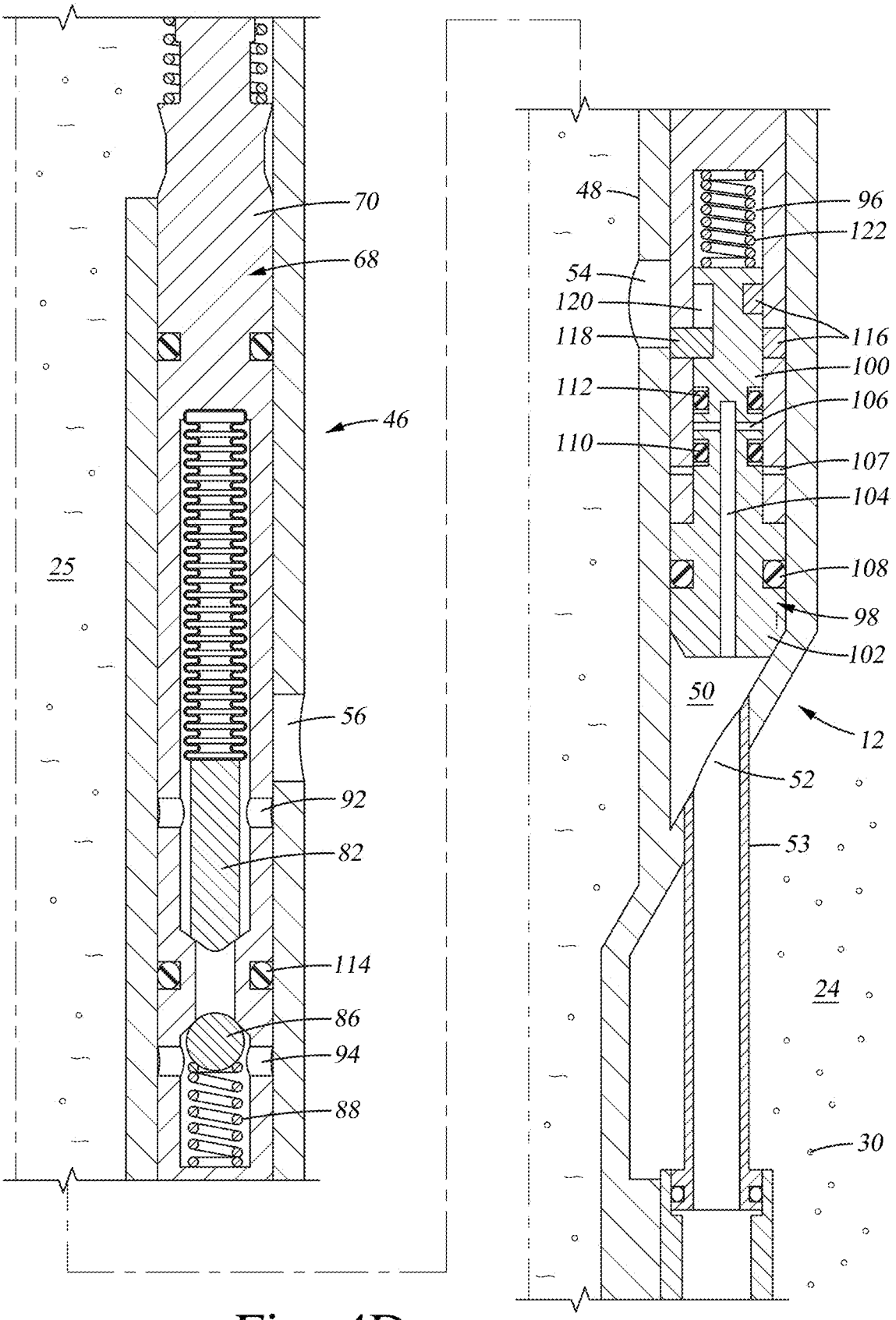
Figure 4E:
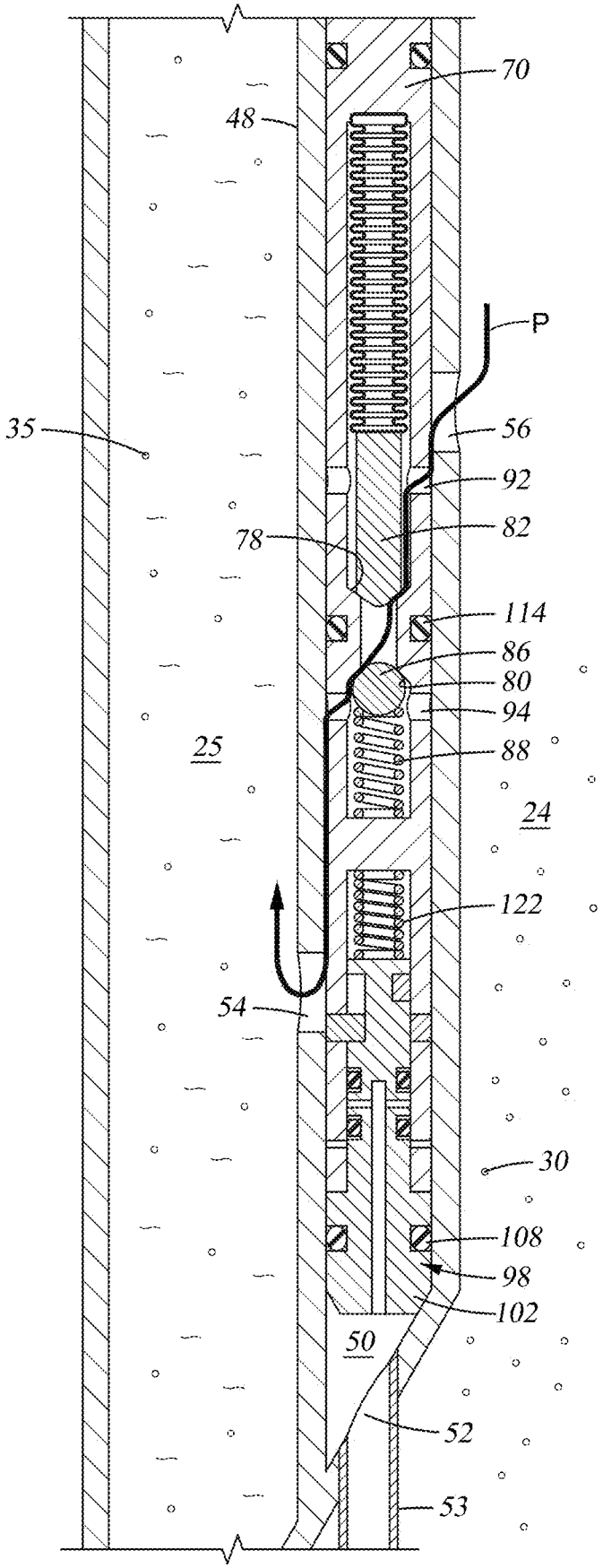
FIG. 4E is a side sectional view of an example of operation of the contingency insert of FIG. 4A.

Referring now to FIG. 4C, further axial urging of the insert 68 into the cylinder 50 fractures shear pin 116 allowing relative movement between the bleed plug 98 and body 70, which moves the port 106 and duct 107 out of registration with one another. As illustrated in FIG. 4D, continued axial urging of the insert 68 into the cylinder 50 urges bleed plug 98 deeper into receptacle 96 and further compressing a spring 122 shown within receptacle 96 and abutting an end of shaft 100 opposite the nose portion 102. The combination of the O-ring seals 108, 114, 110 and 112 and the non-registration of ports and ducts 106, 107 block fluid communication between port 52 and bore 25. Though a path P for lift gas 30 within annulus 24 to be selectively injected into bore 25 is shown in FIG. 4E. In the example of FIG. 4E, the contingency insert 68 operates as an IPO valve, and the lift gas 30 within annulus 24 enters port 56 due to a pressure differential between annulus 24 and bore 25. The path P extends through port 56, across the interfaces between valve elements 82, 86 and shoulders 78, 80, between body 70 and skirt 48, and through port 54 into bore 25. In an alternate embodiment, contingency insert operates as a production pressure valve and responsive to pressure inside the bore 25.

Figure 5A:
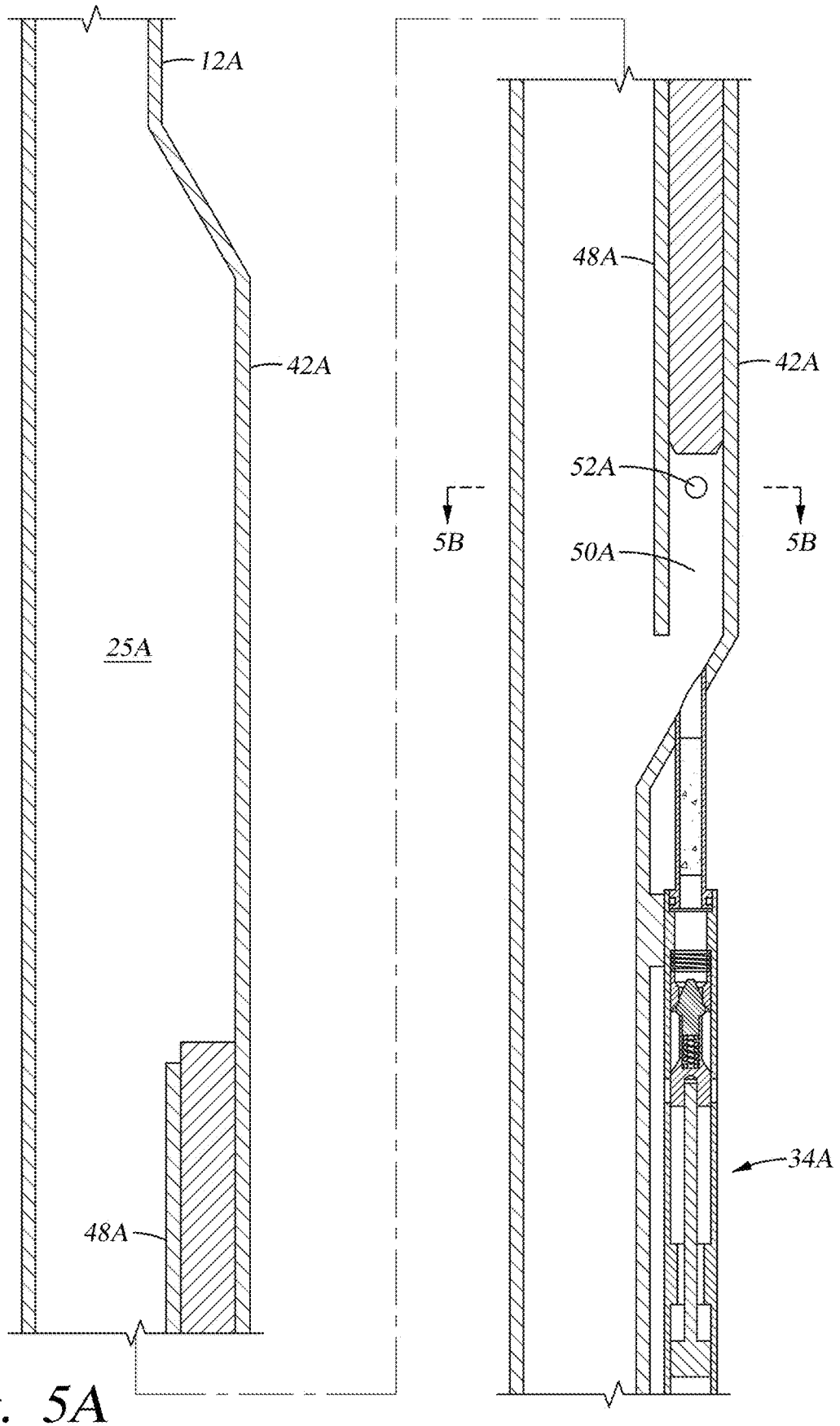
FIG. 5A is an elevational sectional view of the surface controlled gas lift valve installed in an alternate embodiment of a side pocket mandrel.
Figure 5B:
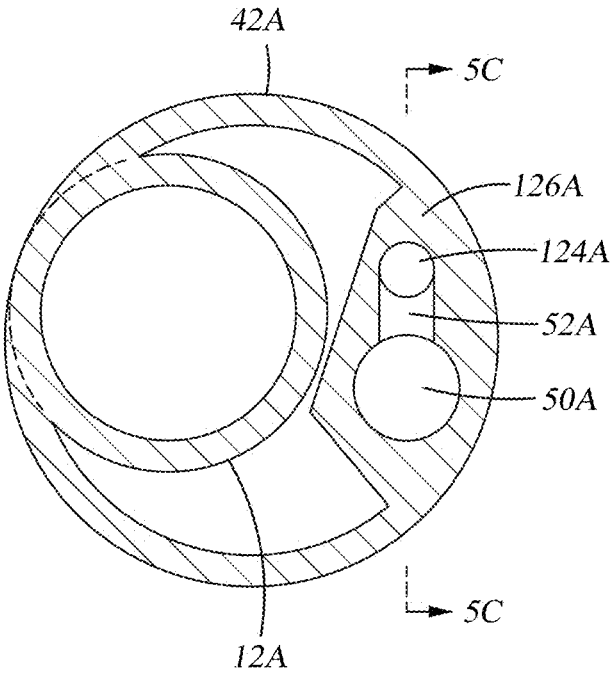
FIG. 5B is an axial sectional view of the side pocket mandrel of FIG. 5A and taken along lines 5B-5B.
Figure 5C:
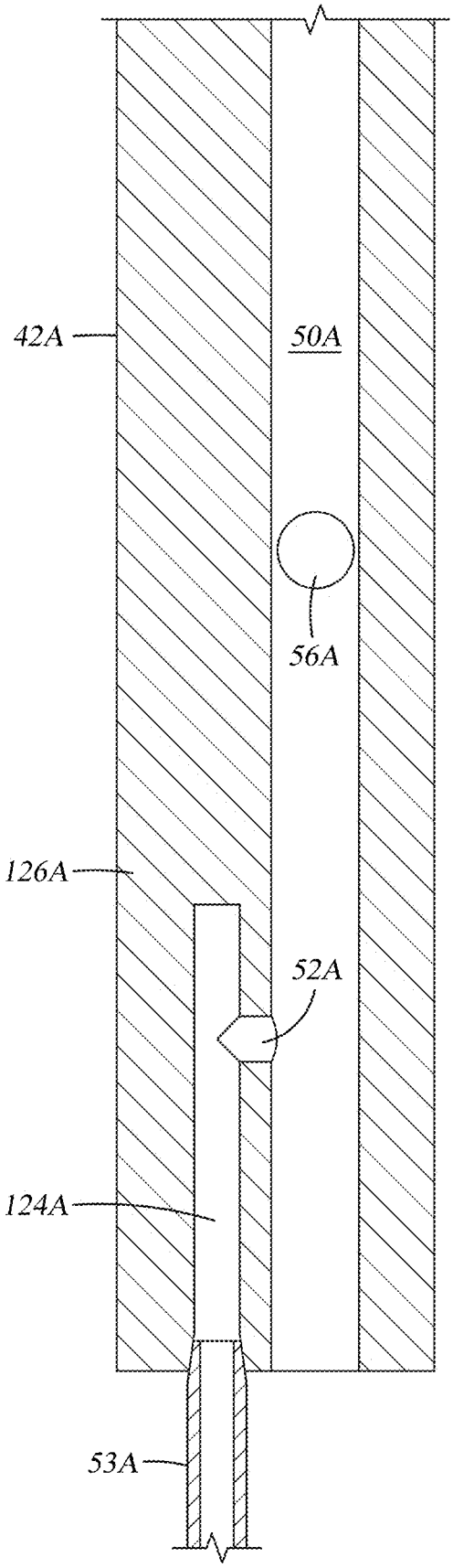
FIG. 5C is an elevational sectional view of a portion of the side pocket mandrel of FIG. 5B and taken along lines 5C-5C.

Shown in FIGS. 5A through 5C is an alternate example of a side pocket mandrel 42A formed on a portion of production tubing 12A. In this example, the inlet port 52A, which is in communication with the SCGLV 34A, is formed through a side wall of the side pocket mandrel 42A and spaced away from its downhole end. Further, the skirt 48A is also spaced away from the downhole end of the side pocket mandrel 42A, and so that fluid cannot collect to hinder full insertion of an insert into cylinder 50A as discussed above in FIG. 3. Shown in an axial sectional view in FIG. 5B, and taken along the lines 5B-5B of FIG. 5A, is that the side pocket mandrel 42A includes a lead port 124A (which similar to the inlet port 52 of FIG. 2) that provides an inlet for lift gas from the SCGLV 34A to make its way into the bore 25A of production tubing 12A. Lead port 124A extends generally axially within a manifold 126A formed in the side pocket mandrel 42A. And shown in FIG. 5C, which is taken along lines 5C-5C of FIG. 5B, is that inlet port 52A provides communication from lead port 124A and into cylinder 50A, where lift gas is communicated through side port 54A into the bore 25A of production tubing 12A (FIG. 5B).

Figure 5D:
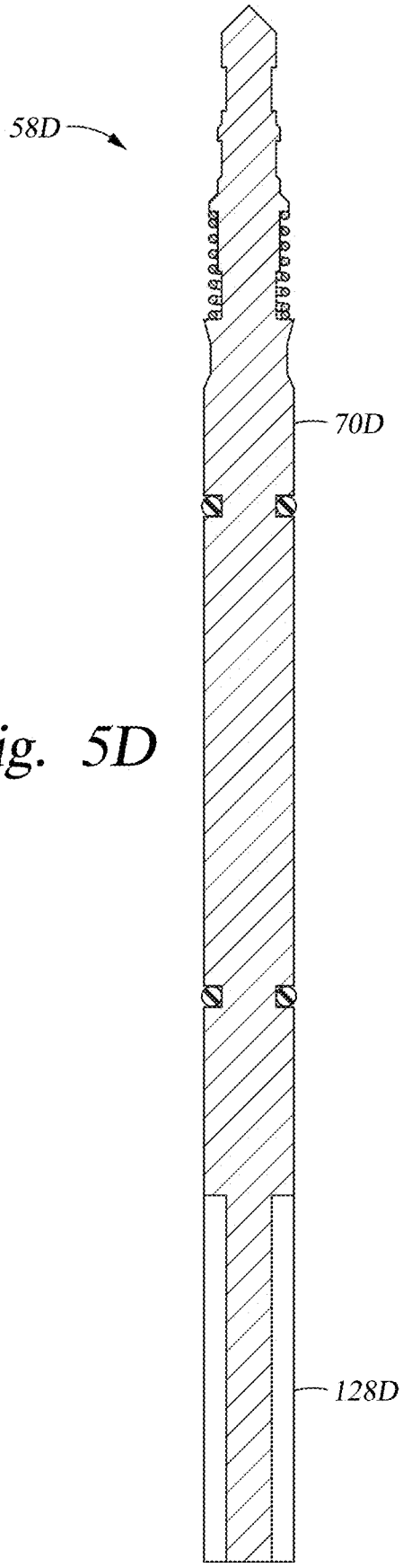
FIGS. 5D-5G are side sectional views of example embodiments of inserts for use in the side pocket mandrel of FIG. 5A.
Figure 5E:
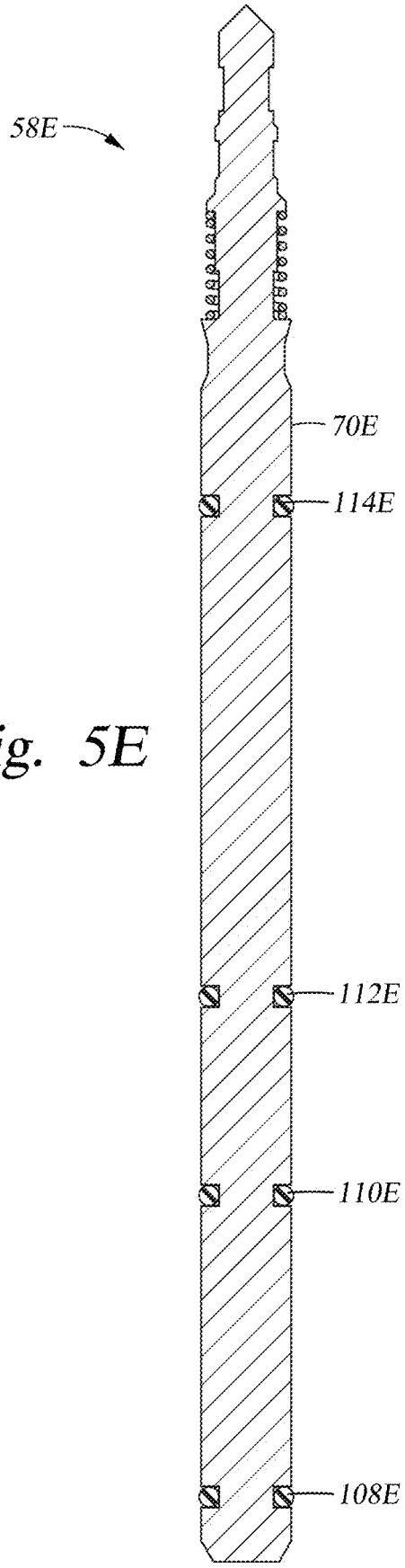
Figure 5F:
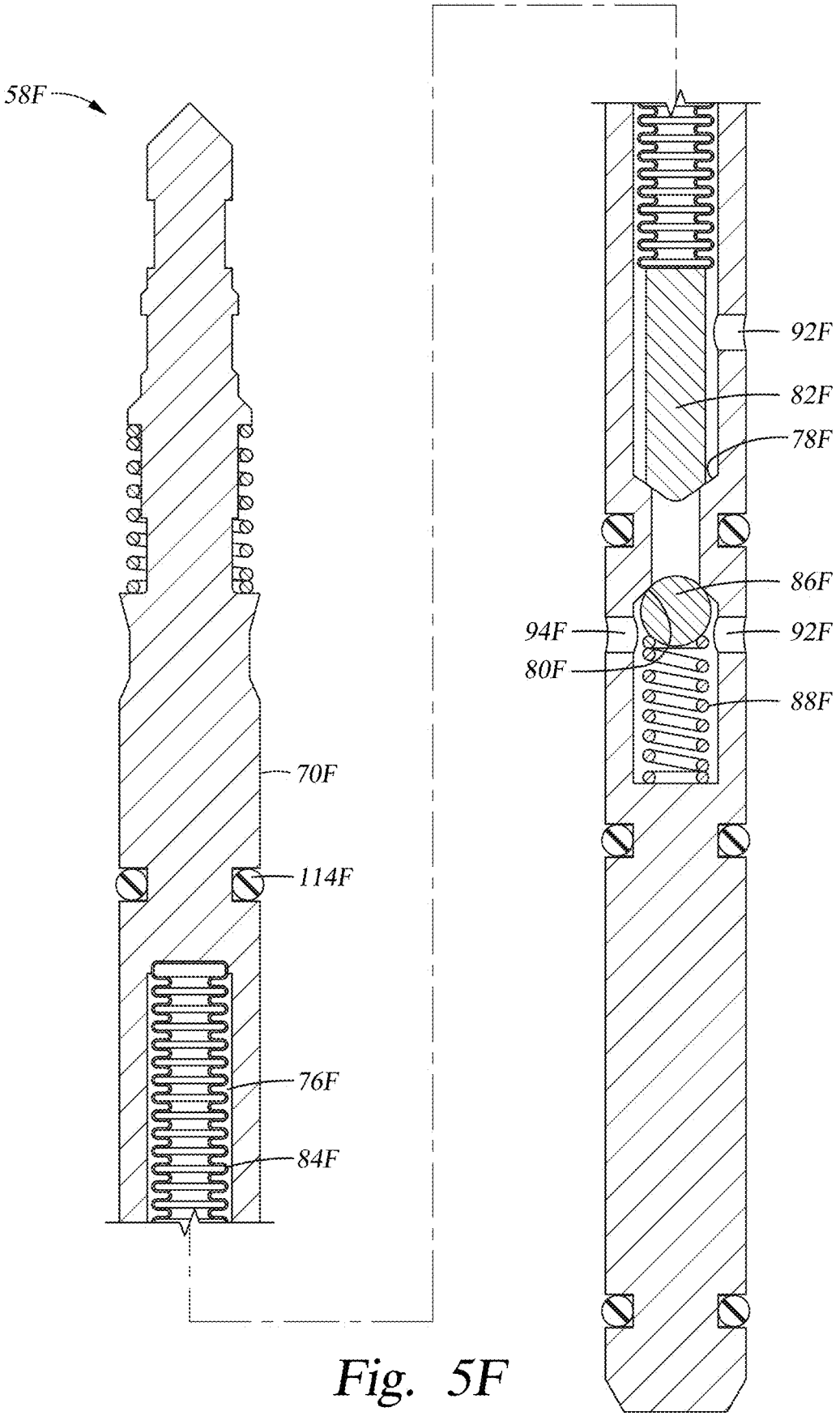
Figure 5G:
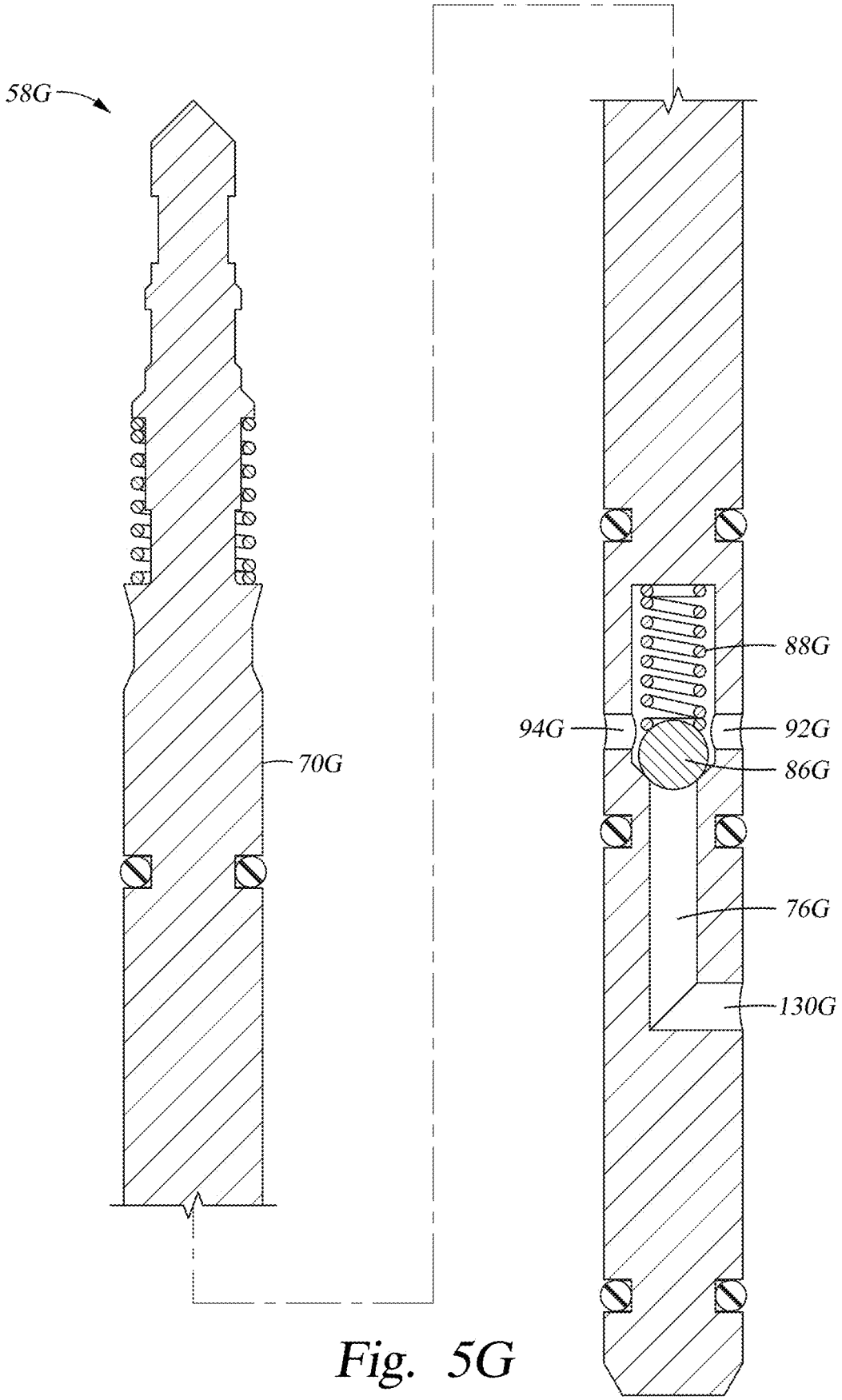

In FIGS. 5D-5G are alternate examples of inserts for installation in cylinder 50A of FIGS. 5A-5C. In the example of FIG. 5D an outer sleeve 128D is provided on a downhole end of the insert 58D, which in alternatives is formed from a material that will not degrade, or degrade to a lesser degree when particles or other abrasive material is suspended within the lift gas. In FIG. 5E is another embodiment of an insert 58E which is dimensioned to fit within cylinder 50A and having strategically located O-ring seals on its outer surface to provide selective isolation to prevent any leakage or flow that may occur through a SCGLV 34A being in a non-operational state. Shown in a side sectional view in FIG. 5F is an alternate embodiment of an insert 58F shown having valve members 82F, 86F, shoulders 78F, 80F, chamber 76F, inlet port 92F, exit port 94F, and to provide operation similar to the IPO valve discussed above with regard to FIG. 4B and FIG. 4E. In another alternative, shown in a side sectional view in FIG. 5G, is an example of an insert 58G which includes a side port 130G formed in its body 70G that intersects chamber 76G within body 70G, within chamber 76G is a valve element 86G that in this example is largely spherical, and a spring 88G is provided to bias valve element 86G into abutting contact with shoulders 78G. The valve element 86G and spring 88G in combination with ports 92G, 94G operate similar to a check valve to allow for lift gas flow through the insert 58G.

Figure 1B:
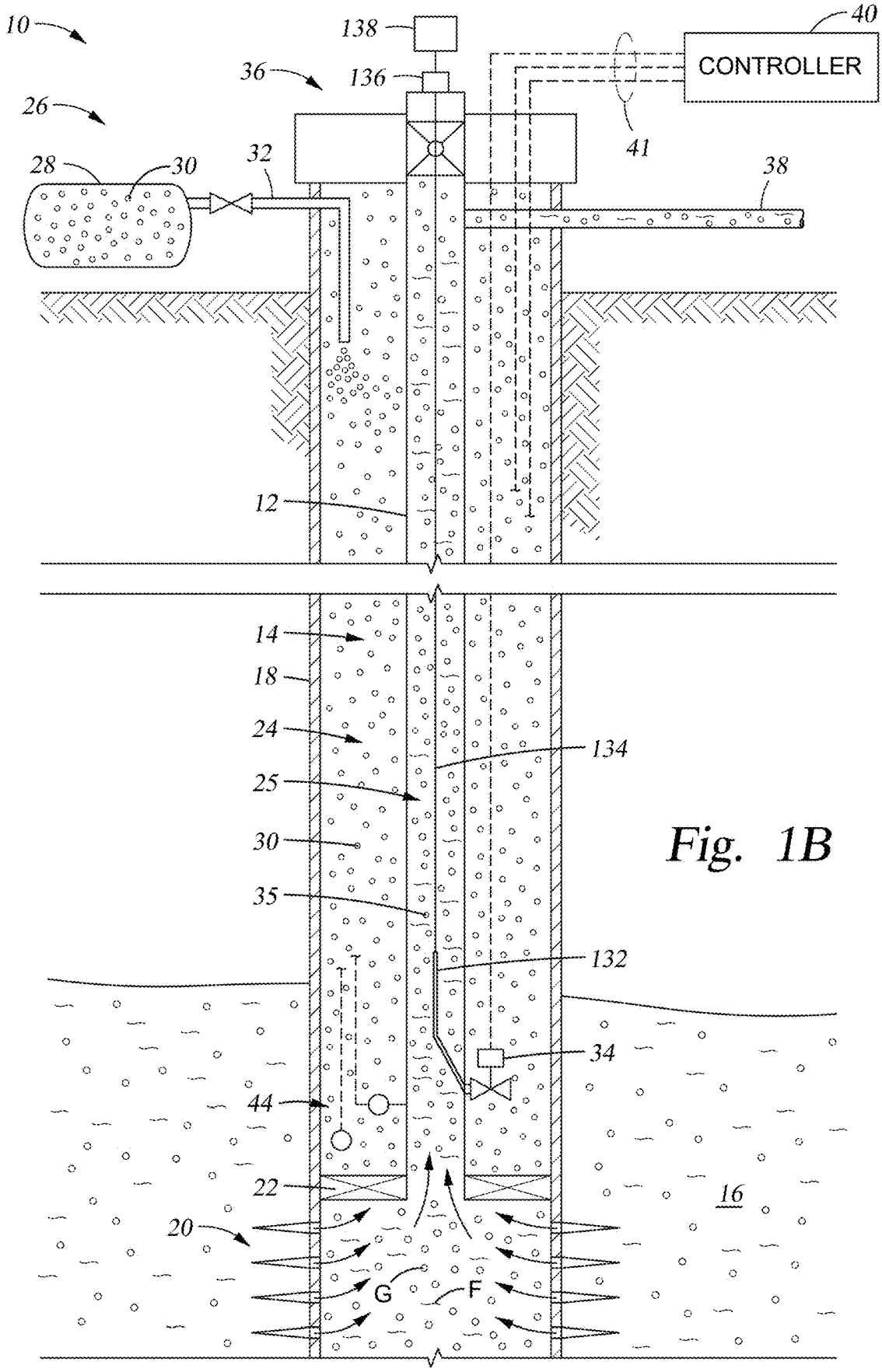
FIG. 1B is a side partial sectional view of an example of conducting a contingency operation on the surface controlled gas lift valve of FIG. 1A.

Referring now to FIG. 1B, shown is an example of operation in which the SCGLV 34 is in a non-operational state, and unable to inject lift gas 30 from the annulus 24 into the production tubing 12. In an embodiment, the non-operational state of the SCGLV 34 is detected by monitoring output signals from the sensors 44 or other sensors (not shown), or diagnostic software within controller 40. To remediate the non-operational state of the SCGLV 34, insert 58 (FIG. 2) is replaced with a contingency insert, such as contingency insert 68 of FIG. 4A. In this example, a kickover tool 132 is shown deployed within the production tubing 12 and suspended on a line 134. An optional lubricator 136 is mounted on an upper end of wellhead assembly 36, which provides pressure control for the line 134. Examples of the line 134 include wireline, slickline, coiled tubing, braided wire, and any other means for deploying a device within a well. A deployment means 138 is schematically shown attached to an end of line opposite kickover tool 132; examples of deployment means 138 include an injector, such as when dealing with coiled tubing, or a winch of when dealing with wireline or slickline. Further in the example, the kickover tool 132 is shown deployed at a depth adjacent to the side pocket mandrel 46 and for handling of the insert 58 and contingency insert 68. After installation of the contingency insert 68, lift gas 30 is selectively injected into the bore 25 by pressurizing lift gas 30 in annulus 24, which as shown in FIG. 4E, injects lift gas 30 into bore 25 and forms bubbles 35 of lift gas 30.

Figure 6A:
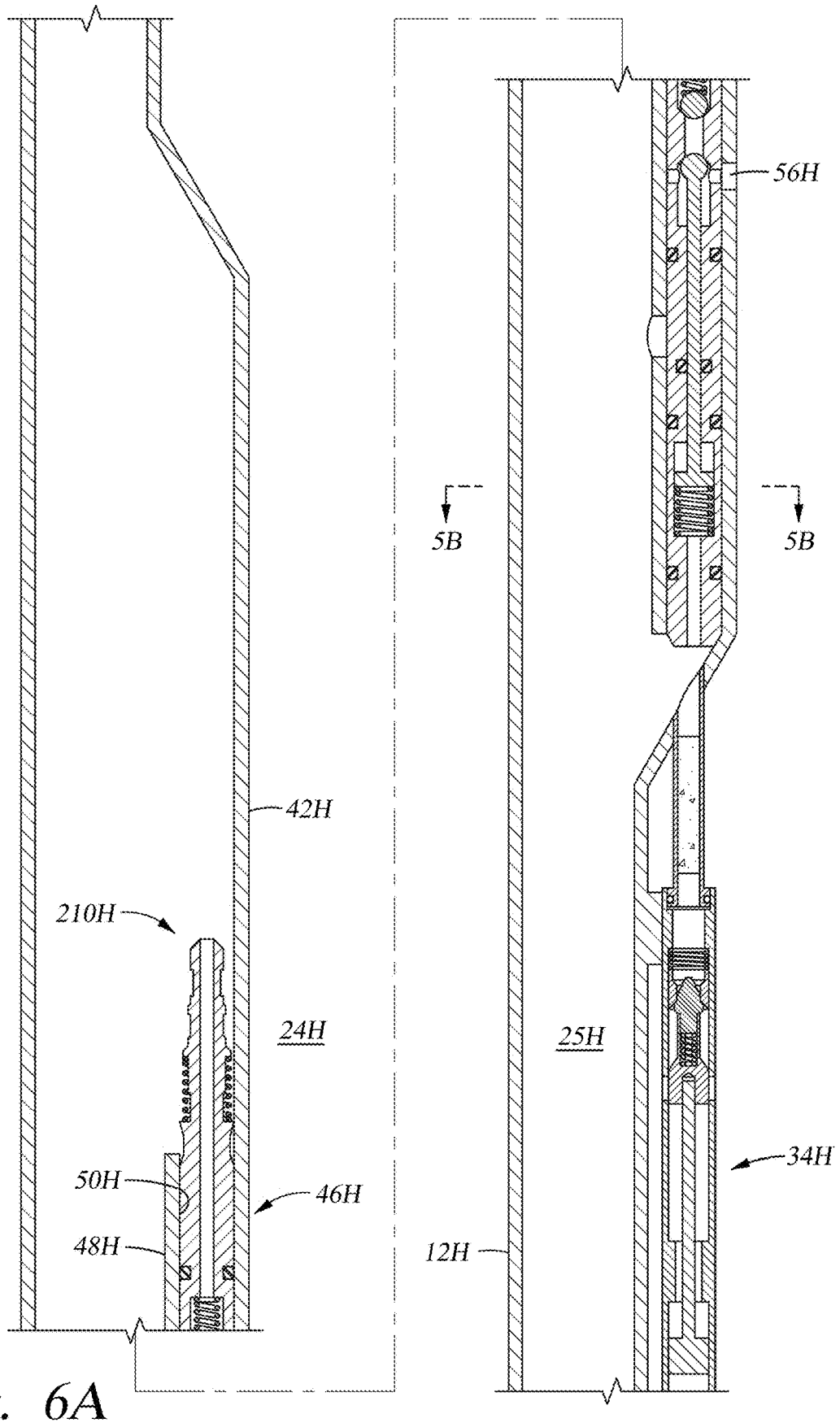
FIG. 6A is an elevational sectional view of a piloted valve installed in the side pocket mandrel of FIG. 5A.

FIG. 6A is a side sectional view of an example of a piloted valve 210H mounted within the cylinder 50H of side pocket mandrel 46H. In this example, SCGLV 34 remains functional and used to actuate piloted valve 210H for injection of list gas 30. Optionally, piloted valve 210H has different flow characteristics than the SCGLV 34. Examples of different flow characteristics include a different time required to reach full open or having a flow rate versus time after actuation, so that while under the same temperature and pressure conditions in the well 12, a different amount of lift gas is injected through the piloted valve 210H at time (t) after actuation than is injected through SCGLV 34 at time (t). In a non-limiting example, piloted valve 210H has a flow characteristic so that more mass or volume of lift gas 30 is injected through piloted valve 210H sooner than is injected through SCGLV 34H. Injecting more lift gas 30 faster creates a greater "inrush" of lift gas 30 into bore 25H. As explained in more detail below, piloted valve 210H is actuated by operation of SCGLV 34H for injecting lift gas 30 (FIG. 1A) in the annulus 24H into the bore 25H of tubing 12H. In examples, the lift gas 30 mixes with fluid inside bore 25H as described above in conjunction with FIG. 1A, and alternatively the lift gas 30 is to conduct gas assisted plunger lift ("GAPL") operations, in which lift gas in annulus 24H is diverted into bore 25H of tubing 12H. A plunger and a column of liquid on top of plunger (not shown) that are within bore 25H and uphole of side pocket mandrel 24H are lifted to surface by injecting the lift gas into the bore 25H. In a non-limiting example, piloted valve 210H is inserted into cylinder 50H after removing insert 58 using kickover tool 132 (FIG. 1B) in a manner the same as or similar to that described above, and at a point in time after initial operation of well system 10. An example of such a point in time is when pressure in the surrounding formation 16 has diminished and the feasibility of continued production from the well system 10 dictates assisted lift. Examples of GAPL operation are found in Watson, U.S. Pat. No. 11,459,862 ("Watson '862") and Shaw, U.S. Pat. No. 11,401,788, both of which are assigned to the assignee of the present application and are incorporated by reference herein in their entireties and for all purposes.

Figure 6D:
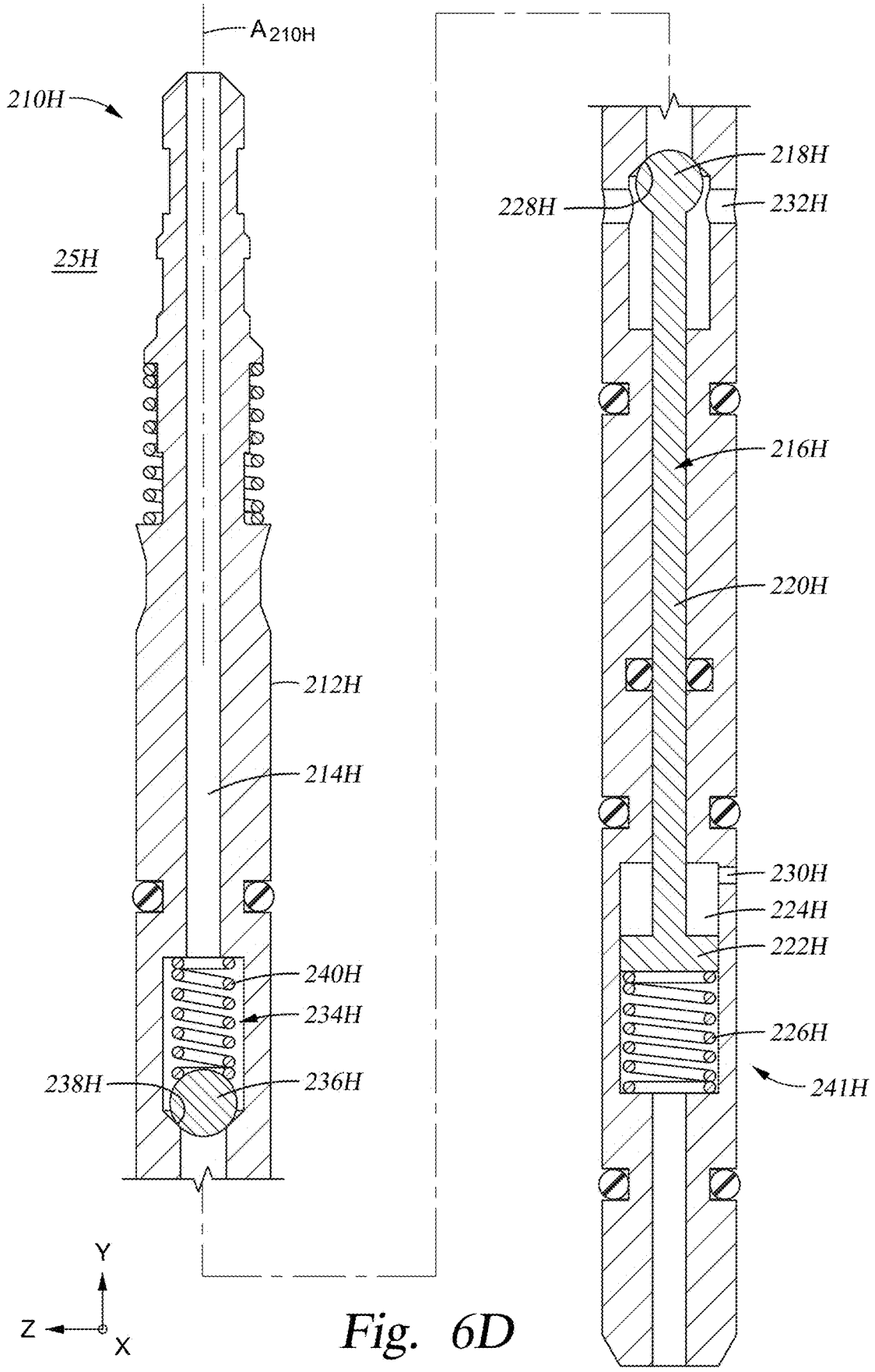
FIGS. 6D and 6E are side sectional views of the piloted valve of FIG. 6A respectively in an closed and open configurations.
Figure 6E:
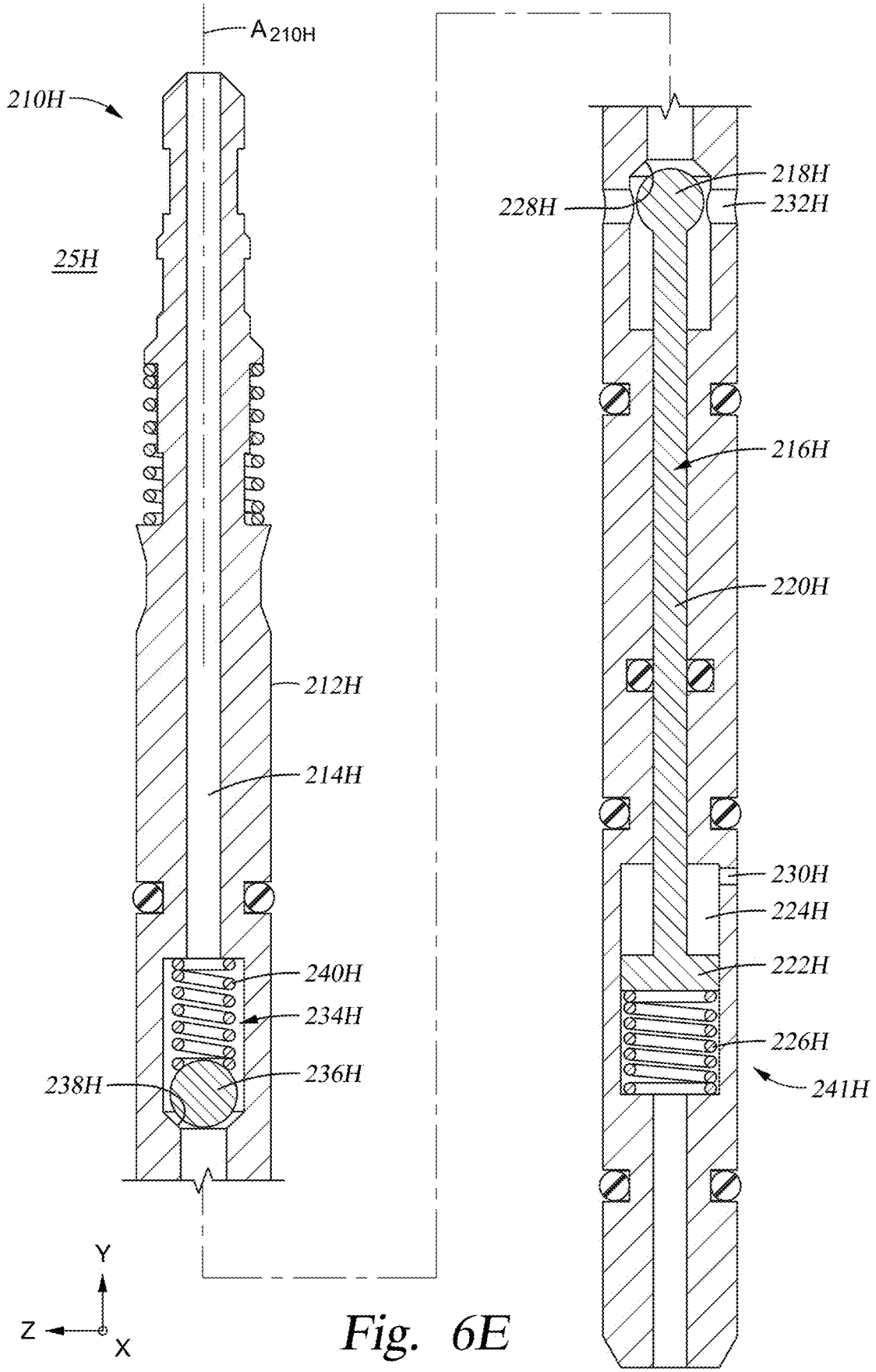

Illustrated in a side sectional view in FIG. 6C is the side pocket mandrel 42H, and in FIGS. 6D and 6E are examples of the piloted valve 210H shown respectively in closed and open configurations. For the purposes of reference, X-Y-Z axes are included in FIG. 6C. In FIGS. 6D and 6E the valve 210H is shown by itself, but aligned along the Y axis with its position when installed in cylinder 50H. In the example shown, valve 210H includes an elongated body 212H having a bore 214H extending lengthwise along axis A210H. Inside bore 214H is a valve member 216H made up of a plug 218H, a stem 220H, and piston 222H. Plug 218H is shown as a generally spherical member and mounted onto an end of stem 220H, which is elongate and generally aligned with axis A210H. Piston 222H is a disk-like member having a rectangular cross section, and shown formed on an end of stem 220H opposite from plug 218H and with its planar surfaces substantially transverse to axis A210H. Piston 222H is disposed in an enlarged diameter portion of bore 214H, which forms a chamber 224H in which piston 222H is axially moveable within. A spring 226H is also in chamber 224H, and in biasing contact with a side of piston 224H opposite its attachment to stem 220H. The biasing effect of spring 226H urges plug 218H into abutting contact with a valve seat 228H, which is formed in bore 214H where the diameter of bore 214H changes abruptly to form an annular shoulder shown facing downhole and in the direction of piston 222H. A port 230H is shown formed radially through a sidewall of body 212H, port 230H provides communication between a portion of chamber 224H uphole of piston 222H and outside of body 212H. When piloted valve 210H of FIG. 6D is inside cylinder 50H of side pocket mandrel 42H, port 230H registers with inlet port 52H in the side pocket mandrel 42H, and port 230H is in communication with both the lead port 124H and an outlet of SCGLV 34H (FIG. 6A). Another port 232H extends radially through the sidewall of body 212H on a side of plug 218H opposite valve seat 228H, port 232H registers with contingency port 56H, and is in communication with annulus 24H via port 56H. In the example of FIG. 6D, piloted valve 210H is in a closed configuration, which blocks fluid communication between annulus 24H and bore 25H.

Referring now to FIG. 6E, plug 218H is spaced axially away from valve seat 228H so that the portion of bore 214H upstream of valve seat 228H is in communication with port 232H. Activating SCGLV 34H (FIG. 6A), such as from surface as described above, opens SCGLV 34H, which as described below, actuates piloted valve 210H to put piloted valve 210H into an open configuration so that lift gas 30 flows from the annulus 24H into the bore 25H. Opening SCGLV 34H allows lift gas 30 to flow from the annulus 24H, through the SCGLV 34H, nipple 53H, and inlet port 52H (FIG. 6C) into chamber 224H via port 230H. A pressure of the lift gas 30 inside chamber 224H generates a force on piston 222H that urges valve member 216H into compressive engagement with spring 224H and spaces plug 218H away from valve seat 228H allowing fluid communication between annulus 24H and bore 25 via contingency port 56H (FIG. 6C) port 232H, and bore 214H. For the purposes of discussion herein, the port 230H, valve member 216H, and spring 226H are referred to as a valve actuator 241H for the piloted valve 210H. In the configuration shown in FIG. 6E, piloted valve 210H is shown in an open configuration, and a flow path exists between annulus 24H to bore 25H through piloted valve 210H. In examples, the dimensions of flow path and pressure differential between the annulus 24H and bore 25H are of appropriate quantities for a gas flow into bore 25H with adequate flow rate and conditions to lift a plunger and a column of liquid above the plunger, where the liquid has particular properties and the column has a particular height.

Still referring to FIGS. 6D and 6E, an optional check valve assembly 234H is shown in bore 214H uphole of valve seat 228H. Check valve assembly 234H permits flow inside bore 214H in a direction uphole (i.e., towards piston 222H from check valve assembly 234H), and prevents flow downhole within bore 214H (i.e., towards check valve assembly 234H from piston 222H). Check valve assembly 234H includes a ball 236H that is urged against an uphole facing shoulder 238H by a spring 240H when piloted valve 210H is in the closed configuration and fluid is not flowing inside the bore 214H. In an embodiment, a spring constant of spring 240H is designated so that when piloted valve 210H is in the open configuration and flow is directed uphole inside the bore 214H, spring 240H compresses when exposed to forces exerted on ball 236H generated by a differential pressure between annulus 24H and bore 25H. Without the biasing effect of the spring 240H, ball 236H is urged away from shoulder 238H in response to fluid flowing inside bore 214H.

Figure 7:
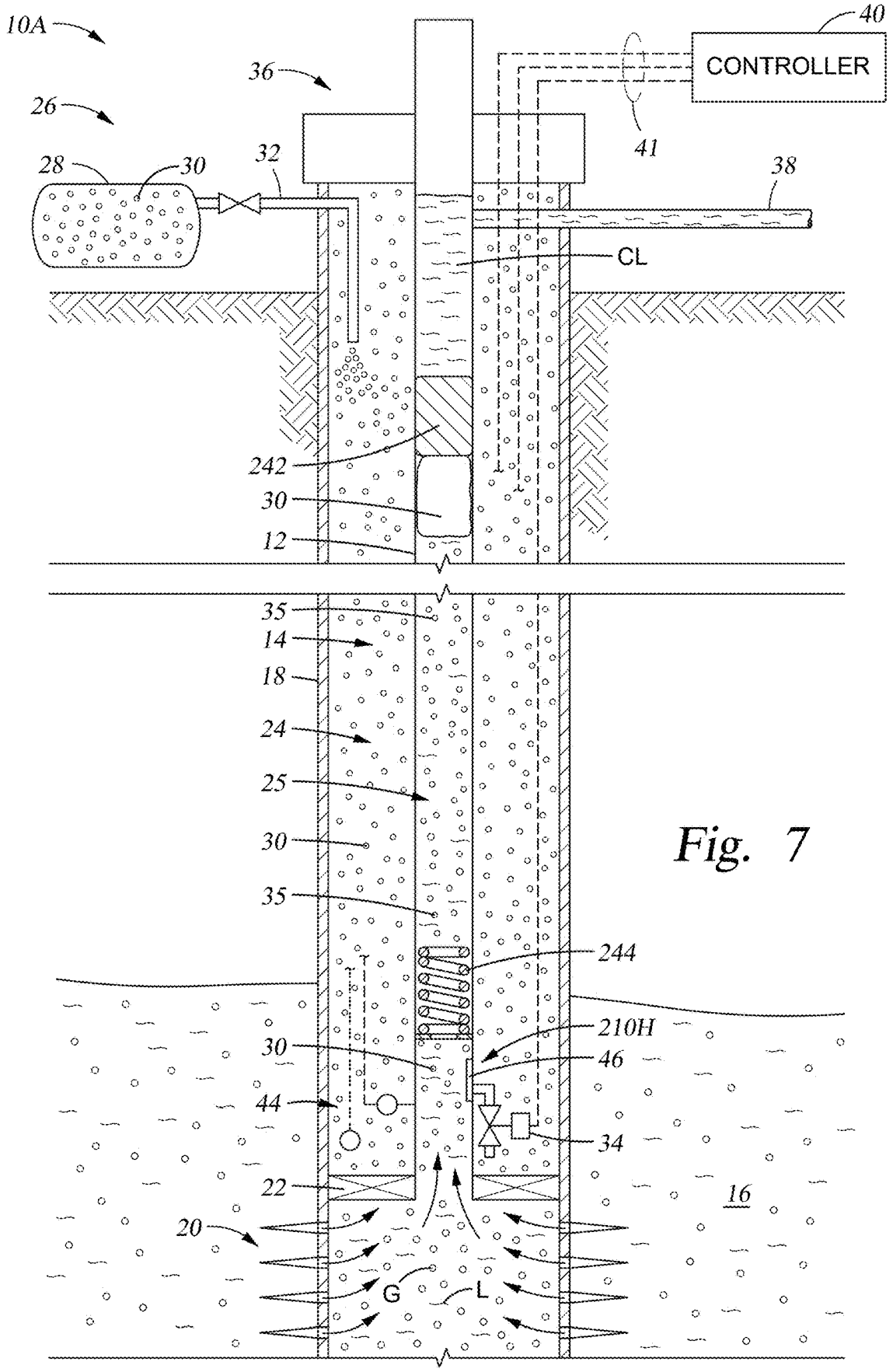
FIG. 7 is a side sectional view of an example of a well undergoing a gas assisted plunger lift operation.

Shown in a side partial sectional view in FIG. 7 is an example of a well system 10A undergoing a GAPL operation, in which a plunger 242 is raised within the bore 25 of production tubing 12 by injecting lift gas 30 into bore 25 to lift a column of liquid CL to production line 38. As noted above, GAPL operations typically do not occur early in the life of a well, but at a point in time when pressure in the surrounding formation 16 has been depleted and is no longer adequate for raising the liquid L from within the well 14 to surface. When well system 10A was initially constructed it included side pocket mandrel 46 and SCGLV 34 attached to side pocket mandrel 46, such as that shown in FIGS. 2 and 3. In this example, at the point in time when pressure in the formation 16 in no longer adequate for hydrocarbon production, operations the same or similar to those described above in conjunction with FIG. 1B were performed to install piloted valve 210H in the side pocket mandrel 46. A spring 244 is shown mounted inside tubing 12, which in this example supports plunger 242 as liquid L accumulates above plunger 242 to form the column of liquid CL. In alternatives, spring 244 is included within tubing 12 when the well system 10A is initially constructed, or at a later point in time. In a non-limiting example of the present GAPL operation, plunger 242 is lowered onto spring 244 so that liquid L accumulates on the uphole surface of plunger 242 to form a column of liquid CL on the plunger 242. When a designated amount of liquid L has accumulated above plunger 242, SCGLV 34 is actuated so that piloted valve 210H is put into an open configuration (FIG. 6E) to inject lift gas 30 into the bore 25. The lift gas 30 is injected below the plunger 242 and column of liquid CL, and the density of the lift gas 30 is sufficiently lower than that of the plunger 242 and liquid L making up the column of liquid CL to generate and exert a buoyancy force to raise the plunger 242 and column of liquid CL within the bore 25 to the wellhead assembly 36. Continued upward urging of the plunger 242 forces the column of liquid CL into the production line 38 for transmission offsite. It is within the capabilities of one skilled in the art to determine a designated amount of liquid L accumulation on a plunger, and to identify when the designated amount of liquid L has accumulated on the plunger, such as by monitoring pressure within well 14 based on signals emitted from sensors 44. After the column of liquid CL is forced into production line 38, the injection of gas lift 30 into the bore 24 is suspended by deactivating the SCGLV 34 to close the piloted valve 210H. Without the buoyancy force provided by the low density lift gas 30 inside the bore 25, gravitational forces cause the plunger 242 to fall within the bore 25 and land on the spring 244. Hydrocarbon production from the well 14 continues by repeating the steps of accumulating, lifting, and falling. As noted above, an advantage of the well system 10A of FIG. 7 is that a wider range of different lift gas injection flow rates and flow characteristics are achievable by injecting lift gas through the disclosed piloted valve 210H rather than the SCGLV 34, and using the SCGLV 34 for actuating the piloted valve 210H enables creating a greater inrush of lift gas into the bore 25 . . . . Examples of designated flow characteristics include a cycle time of pilot valve actuation, such as, the frequency of operation, a time between when the valve is kept in a closed configuration and a time span when the valve is kept in the open configuration. An example of when well production can be increased occurs when conditions in the well 14 have changed (such as evidenced by monitoring with the sensors 44). Based on the monitoring, adjustments to the flow rate of lift gas injection are made to increase production.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Embodiments of the surface controlled flow valves include other types of flow control valves for controlling flow in a wellbore, such as inflow control valves and/or circulation valves. Alternatives exist in which a piloted valve is installed in a side pocket mandrel of production tubing at the time a well is constructed, and lift gas is injected through the piloted valve at a time when the well begins operation-optionally, the piloted valve is replaced with a different piloted valve having the same or different flow characteristics. These and other similar modifications will readily suggest themselves to those skilled in the art, and are intended to be encompassed within the spirit of the present invention disclosed herein and the scope of the appended claims.

What is claimed is:

1. A method of wellbore operations comprising:

injecting lift gas into the wellbore through a piloted valve in a side pocket mandrel of production tubing installed in the wellbore, the piloted valve comprising an inlet, an outlet, and an actuator that opens and closes the piloted valve in response to pressure; and controlling operation of the piloted valve with a surface controlled gas lift valve by selectively communicating pressure from an annulus circumscribing the production tubing through the surface controlled gas lift valve and to the actuator, the surface controlled gas lift valve being disposed in the wellbore outside of the side pocket mandrel.

2. The method of claim 1, wherein the step of communicating pressure comprises actuating the surface controlled gas lift valve to cause fluid to flow through the surface-controlled gas lift valve, and wherein controlling operation of the piloted valve comprises opening the piloted valve by directing fluid exiting the surface-controlled gas lift valve to the actuator.

3. The method of claim 1, further comprising conducting gas lift operations in the wellbore by actuating the surface controlled gas lift valve for a period of time prior to injecting the lift gas through the piloted valve, removing a blind insert from the side pocket mandrel, and installing the piloted valve in the side pocket mandrel in place of the blind insert.

4. The method of claim 3, wherein the lift gas injected through the piloted valve mixes with fluid inside the production tubing to form a mixture that flows upward inside the production tubing to surface.

5. The method of claim 3, wherein the lift gas injected through the piloted valve is used for conducting gas assisted plunger lift operations in the wellbore.

6. A method of wellbore operations comprising:

for a period of time, injecting lift gas into a flow of production fluid in the wellbore through a surface controlled gas lift valve that has an outlet port in communication with a side pocket mandrel in a string of production tubing in the wellbore;

after the period of time, installing a piloted valve in the side pocket mandrel, the piloted valve comprising an inlet in communication with a source of the lift gas, an outlet in communication with the flow of production fluid, and an actuator in fluid communication with an exit of the surface controlled gas lift valve;

activating the surface controlled gas lift valve to communicate pressure from an annulus surrounding the production tubing through the surface controlled gas lift valve and to the actuator to open the piloted valve; and injecting lift gas into the wellbore through the open piloted valve.

7. The method of claim 6, wherein the lift gas injected through the piloted valve mixes with fluid inside the production tubing to form a mixture that flows upward inside the production tubing to surface.

8. The method of claim 6, wherein the lift gas injected through the piloted valve is used for conducting gas assisted plunger lift operations in the wellbore.

9. The method of claim 6, further comprising removing an insert from the side pocket mandrel prior to installing the piloted valve.

10. The method of claim 9, wherein a cycle time of the piloted valve differs from a cycle time of the surface controlled gas lift valve based on monitoring conditions in the wellbore.

11. The method of claim 9, wherein an open time of the piloted valve differs from an open time of the surface controlled gas lift valve based on monitoring conditions in the wellbore.

12. The method of claim 6, wherein flow characteristics of the piloted valve are different from flow characteristics of the surface controlled gas lift valve.

13. The method of claim 12, wherein the flow characteristics of the piloted valve are based on monitoring conditions in the wellbore.

14. A system for use in wellbore operations comprising:

a pilot operated valve ("POV") comprising a valve actuator, a POV inlet in communication with an annulus circumscribing a production string in the wellbore, and a POV outlet in communication with a bore in the production string, the POV having an open configuration in which the POV inlet and outlet are in communication with one another and a closed configuration in which a flow barrier is between the POV inlet and outlet; and a surface controlled gas lift valve ("SCGLV") having a SCGLV inlet port in communication with the annulus and a SCGLV outlet port in communication with the actuator, the SCGLV having an open configuration in which the SCGLV inlet and outlet ports are in fluid communication and a closed configuration in which a flow barrier is between the SCGLV inlet and outlet ports, the SCGLV changeable into the open configuration when activated, and the POV is changeable into the open configuration in response to an applied pressure to the valve actuator.

15. The system of claim 14, wherein the POV is installed in a side pocket mandrel of the production string.

16. The system of claim 14, wherein the SCGLV is coupled to the production string and wherein a nipple connects the SCGLV outlet to the POV actuator.

17. The system of claim 14, wherein the POV comprises an elongated body, a chamber inside the body and a valve member selectively moveable in and out of a flow path between the POV inlet and outlet.

18. The system of claim 17, wherein the valve member is moveable out of the flow path when the SCGLV is activated.

19. The system of claim 18, wherein the valve member comprises a plug, a piston, and an elongated stem connecting the plug and the piston, wherein the plug abuts the POV outlet when the POV is in the closed configuration to define a flow barrier between the inlet and outlet, wherein in response to a flow of fluid from the SCGLV the piston and plug are moveable in a direction away from the POV outlet to space the plug away from the POV outlet, and wherein the POV is in the open configuration when the plug is spaced away from the POV outlet.

20. The system of claim 14, wherein the SCGLV outlet port is in communication with the actuator along a flow path that is isolated from the POV inlet and outlet.

* * * * *